US008032989B2

(12) United States Patent
Liang et al.

(10) Patent No.: US 8,032,989 B2
(45) Date of Patent: Oct. 11, 2011

(54) CASEMENT WINDOW HINGE

(75) Inventors: Luke Liang, South Plainfield, NJ (US); Tong Liang, Guang Zhou (CN); David Chen, Guang Zhou (CN)

(73) Assignee: Vision Industries Group, Inc.

( * ) Notice: Subject to any disclaimer, the term of this patent is extended or adjusted under 35 U.S.C. 154(b) by 492 days.

(21) Appl. No.: 11/903,745

(22) Filed: Sep. 24, 2007

(65) Prior Publication Data

US 2009/0077897 A1 Mar. 26, 2009

(51) Int. Cl.
*E05D 15/00* (2006.01)

(52) U.S. Cl. ..... 16/362; 16/363; 16/371; 49/345

(58) Field of Classification Search ..... 16/362–364, 16/366, 368, 371, 374, 235; 49/248, 252, 49/345

See application file for complete search history.

(56) References Cited

U.S. PATENT DOCUMENTS

| | | | | |
|---|---|---|---|---|
| 4,726,092 | A * | 2/1988 | Tacheny et al. | 16/364 |
| 4,980,947 | A * | 1/1991 | McQuigge | 16/235 |
| 2007/0289100 | A1 * | 12/2007 | Lake et al. | 16/362 |
| 2008/0000159 | A1 * | 1/2008 | Gilbert | 49/345 |

* cited by examiner

*Primary Examiner* — William L. Miller

(74) *Attorney, Agent, or Firm* — Thomas A. O'Rourke; Bodner & O'Rourke, LLP

(57) ABSTRACT

A hinge for casement windows is disclosed. The said hinge includes a track and a shoe that is adapted to travel along the track. There is a sash arm that is pivotally connected and extending from the shoe and a support arm. The support arm has a first end and a second end. The first end is pivotally connected to the sash arm and said second end of the support arm is pivotally connected to the track. The support arm has an orifice for receiving a pin extending from the track. The support arm has a clip for securing the support arm to the track. The clip has a grip extending therefrom to assist in moving the clip from a first position to a second position.

34 Claims, 42 Drawing Sheets

FIG. 45
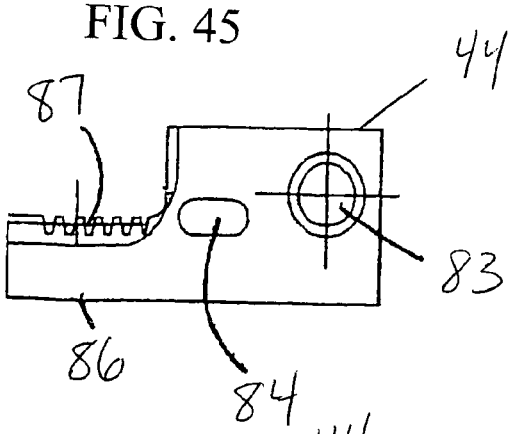
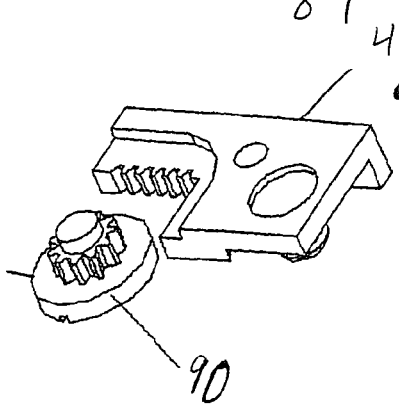
FIG. 46
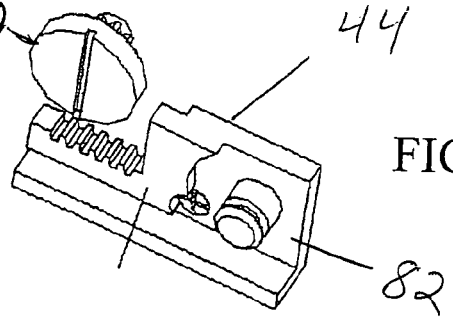
FIG. 47
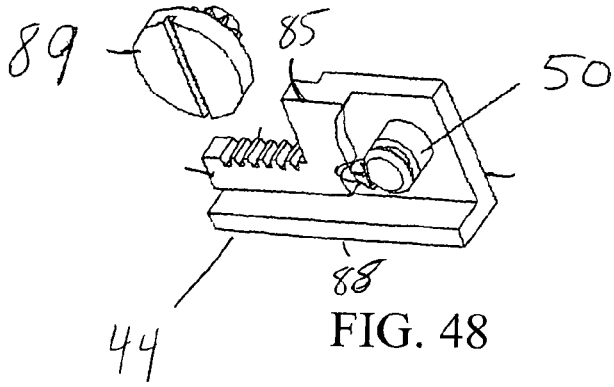
FIG. 48

CASEMENT WINDOW HINGE

FIELD OF THE INVENTION

The present invention relates generally to the field of hinges for casement windows and, more particularly, to improvements in the adjustability of such hinges.

BACKGROUND OF THE INVENTION

In most construction there are a variety of window types that are available. These windows may include fixed, double hung, casement, transom, etc. Each window has certain benefits and drawbacks. Fixed windows for example are not able to be opened for ventilation. Double hung windows were originally designed to let cooler air in the lower portion and hotter air out the upper portion. Casement windows are advantageous in that the entire window can open.

Traditional double hung windows ride in a track and are raised and lowered for ventilation. Casement windows are windows that are mounted in a frame and are hingedly connected on one side to a frame, or to the top and bottom, by usually a pair of hinges. Casement windows typically open outwardly, although, there are some casement type windows that open inwardly instead. The pair of hinges that connect a casement window to a frame are usually situated at the tops and bottoms of the windows. The hinges have a track mounted to the window frame and a sash arm connected to the window. The sash arm is connected to the track by a support arm. The support arm is usually pivotally connected to both the track and the sash arm. The sash arm is also pivotally connected to a mounting shoe, which is supported and guided during movement by the track. Another type of hinge mechanism for casement windows has a link between the sash arm and the movable shoe to offset the sash arm.

The hinge mechanism in casement windows is subject to stress over time. There is a risk that the window may become misaligned whether through poor installation, the weight of the window, weathering or moisture or simply just settling of the house. The hinge mechanism has to compensate for these variations over time. In addition, the fixed track pivot must be properly located relative to the window sash. The fixed track pivot is usually positioned between the support arm and the window frame for proper operation of the window. One of the problems that may be encountered over time is the shifting of the fixed track pivot due to shifting of the window, the window frame, etc., which may result in sagging of the sash. In the event the sash sags, there is a risk that the window may not seal properly and permit moisture and cold air to enter. Another problem that may be caused by sagging of the sash is difficulty in opening and closing the window.

Prior art casement windows attempted to overcome problems with sagging of the sash by requiring precise installation of the hinge mechanism. Another approach has been to permit adjustment of the track to compensate for the sagging sash. In these windows, however, repeated adjustment of the track could result in the mounting assembly for the track undergoing fatigue and gradually loosening. In addition, to adjust the track of many casement windows the window must be open and it is difficult to determine whether the window will close satisfactorily when the adjustment is made. As a result, there is a need for the casement window hardware to be particularly strong and withstand the stresses of opening and closing these windows as well as the weight of the window and settling of the house.

As a result, there is a need for an improved hinge for casement windows which will permit the installer, repair person and/or home owner to adjust the hinge either during installation or later to compensate for sagging of the sash, frames being out of alignment, and other problems with the casement windows that made it difficult to install the windows or adjust their movement once they have been installed in a window.

A further complication with casement windows is the difficulty of adjusting the hinges in order to permit the window to open wider. In an emergency situation where the casement window needs to be opened further than permitted by the hinge, there is a need for a mechanism by which a user can easily disassemble the hinge and open the window as wide as needed. Further, any improvement in the ease with which a user can adjust the casement window hinge would greatly assist that user in installation and cleaning of the casement and save time and stress.

OBJECTS OF THE INVENTION

It is therefore an object of the present invention to provide an improved hinge for casement windows.

It is a further object of the present invention to provide a casement window hinge that is more adjustable than traditional hinges.

It is a further object of the present invention to provide a hinge for casement windows that is stronger than traditional casement hinges.

It is another object of the present invention to provide an improved casement window hinge that will prevent the casement window from becoming misaligned over time.

It is still another object of the present invention to provide a casement window hinge that assists in preventing the casement window from sagging.

It is a still further object of the present invention to provide a casement window hinge that is resistant to wear and tear over time.

It is also an object of the present invention to provide casement window hinge which may be easily disassembled when necessary in the case of an emergency or situation.

SUMMARY OF THE INVENTION

The present invention is directed to a casement window hinge that can be easily disassembled in the event of an emergency, danger, or even for installation of cleaning of the windows. The invention consists of a track that may be secured to a casement window frame, a sash arm extending from said track and a support arm that connects the sash arm and the track. On one side or edge of the track there is a rail for retaining a sliding shoe and permitting the shoe to travel along the rail in the track as the window is opened and closed. The sash arm is pivotally mounted at one end thereof on the track by means of a sliding shoe. The shoe is connected to the sash arm by a suitable connection means such as a screw, pin or a rivet. The connection means should permit pivotal movement of the sash arm in relation to the shoe. The sash arm has another connection means which can also be a screw, pin or rivet, that connects the sash arm to the support arm at any one of a number of locations along the sash arm. The multiple connection points increase the adjustability of the hinge to fit any number of casement windows as well as correct minor errors in installation or sagging over time. The connection means joining the sash arm and support arm should also permit pivotal movement of the two arms. The sliding shoe is preferably retained in the track to prevent it from becoming separated from the track and the shoe should be able to ride along the track longitudinally as necessary to permit movement of the window.

The sliding shoe has a plate that has a generally flat portion which is provided with two orifices. The first of these orifices provides a means for connecting the sash arm to the shoe. The second orifice provides a second location for securing the sash arm to the shoe for different windows. Extending upwardly from the top surface of the plate is a ridge or flange that retains the shoe in the rail. On the underside of the plate there are a first rim and a second rim that raise the plate above the track surface so that a rivet or bolt, or pin or screw that is inserted into either of the two orifices to secure the sash arm to the hinge does not interfere with the travel of the hinge along the track.

One end of the support arm is pivotally connected to the sash arm. The other end of the support arm is connected to the track or some secondary structure that is, itself, connected to the track. For instance, in one preferred embodiment, the other end of the support arm is connected to a second shoe or gear rack. The second shoe has a fixed position on the track and permits the second end of the support arm to pivot about a pin during opening and closing of the window. In another embodiment, the other end of the support arm is connected to a block. The block may be of any practical shape or configuration, but it preferably has a lip or flange for receiving the sliding shoe. The sliding shoe acts to impede the travel of the sliding shoe along the rail of the track, when the window is opened. However, the block has a recess on its surface for a user to grip and it may be pivoted around the axle of whatever connecting mechanism (screw, stud, pin, etc.) attaches it to the support arm. In this way, the window may be opened wider if so desired. Although this block may be of any practical shape or configuration, in the preferred embodiment, it contains a detent in order to prevent the block from rotating around the pin back and forth between the open and closed positions. Finally, the support arm does not have to be connected to a secondary structure at all, but may, alternatively, be connected directed to the track by a screw, pin, stud, or other connective means.

In one embodiment of the present invention, the support arm is retained on the pin by a clip. The clip is preferably rounded and it fits itself within a recessed portion in the pin, stud, or screw used to attach the support arm. The clip also has two flanges extending downward around the sidewalls of the support arm and two more extensions for receiving the support arm. Extending outward from the flange, in the preferred embodiment, is at least one gripping mechanism, more preferably, a protrudent ring, that may be gripped by a user and pulled in order to detach the clip from the pin or stud to which it is secured. In this manner, the casement window may be opened completely In the event of an emergency or even simply to assist in the cleaning or installation of the window. Any secondary structure or connective means is preferably secured to the track through an orifice in the track that lines with any orifice in the second shoe or block by a screw or other means that preferably passes through the track orifice and enters the window frame. Preferably, the orifice or slot is oblong, i.e., a relatively long narrow opening. The longer the slot the greater the amount of adjustability that is possible along the track of the hinge.

In addition to the connection of the support arm to the track or a block or second shoe, the present invention contains a means of restricting the angle at which the window may opened. This may be achieved by any practicable means. But, in the preferred embodiments of the present invention, there are several examples of how this may be achieved. For instance, in one embodiment, a stopper on the bottom surface of the sash arm makes contact with the side wall of the support arm and prohibits the angle created between the sash arm and the support opening beyond a certain degree. Another embodiment utilizes a detent clip which is mounted to the rail of the track to impede the travel of the sliding shoe along the rail. When a user desires the sliding shoe to pass over the clip, the clip may be pressed down. But, when the clip is in its normal raised position in relation to the track, the raised end of the clip makes contact with the sliding shoe and prohibits further travel down the track. And, a final example, of a stopping mechanism is the block discussed above.

BRIEF DESCRIPTION OF THE DRAWINGS

FIG. 45 is a side view of the second shoe of the casement window hinge of FIG. 9.

FIG. 46 is an underside perspective view of the gear rack of the second shoe of FIG. 45.

FIG. 47 is a front perspective view of the gear rack of the second shoe of FIG. 45.

FIG. 48 is a side top perspective view of the gear rack of the second shoe of FIG. 45.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention is an improved hinge for casement windows that utilizes a circled clip, preferably with a protrudent ring for easy removal of the clip and egressing of the window when the user has need to open the window fully or is in a dangerous circumstance. The casement window hinge of the present invention generally consists of a support arm and sash arm joined by a rivet and connected to a track on which they slide. The support arm, however, has the ability to be disconnected from the stud that attaches it to the track on which it slides. There are several preferred embodiments of the hinge of the present invention that all achieve effectively the easy removal of the support arm from its track in order to disassemble the hinge in an emergency.

Figure 6:
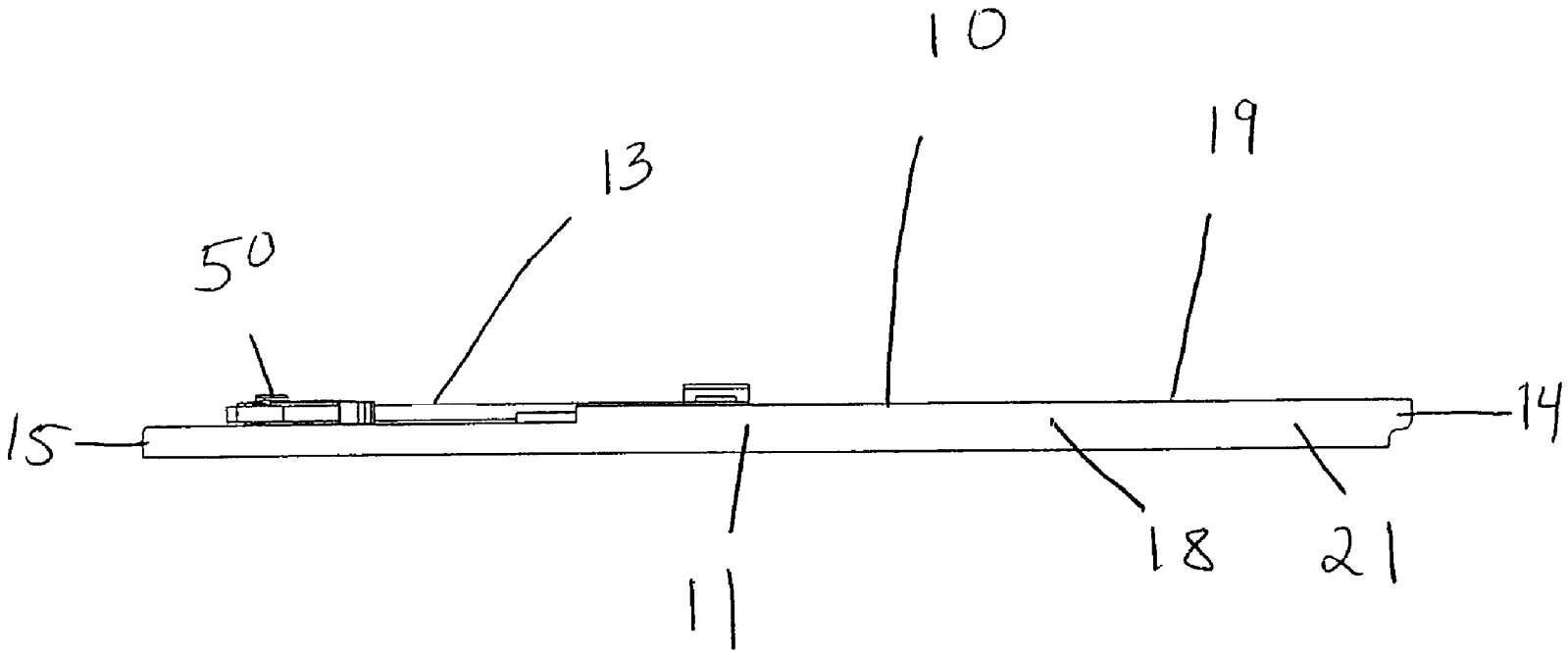
FIG. 6 is an end view of the casement window hinge of FIG. 1 showing the end opposite that shown in FIG. 5.

A preferred embodiment of the casement window hinge 10 of the present invention is shown in FIGS. 1-4. The hinge comprises a track 11 and two arms 12 and 13. The track 11 is preferably a generally rectangular sheet of metal or plastic having a first end 14 and a second end 15. The ends 14 and 15 are joined together by a first side 16 and a second side 17. The second side 17 preferably is provided with a rail 18 for retaining the sliding shoe and permitting it to travel along the rail 18 in the track 11. The rail 18 may be any suitable means to retain the shoe and permit it to ride along the rail 18. The rail 18 has a top member 19, and a first 20 and second rail side member 21 (see FIG. 6). The first rail side member 20 may be adhered to the track 11 by any suitable means such as welding or it may be integral with the track 11. The track 11 is provided with one or more orifices 22 and that enable the track 11 to be secured to the frame of the casement window by screws or other fastening devices.

Figure 1:
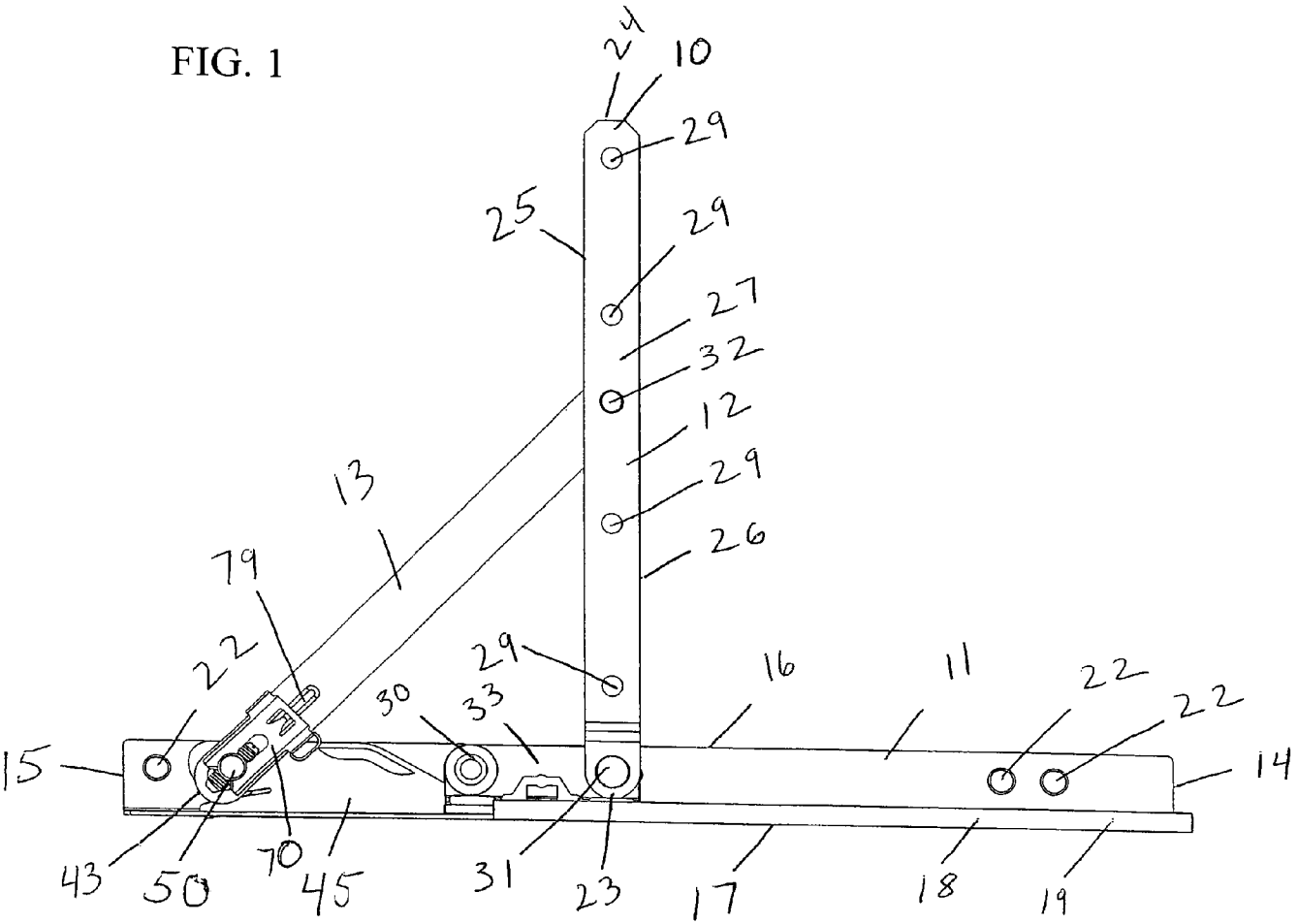
FIG. 1 is a top view of a preferred embodiment casement window hinge of the present invention.
Figure 2:
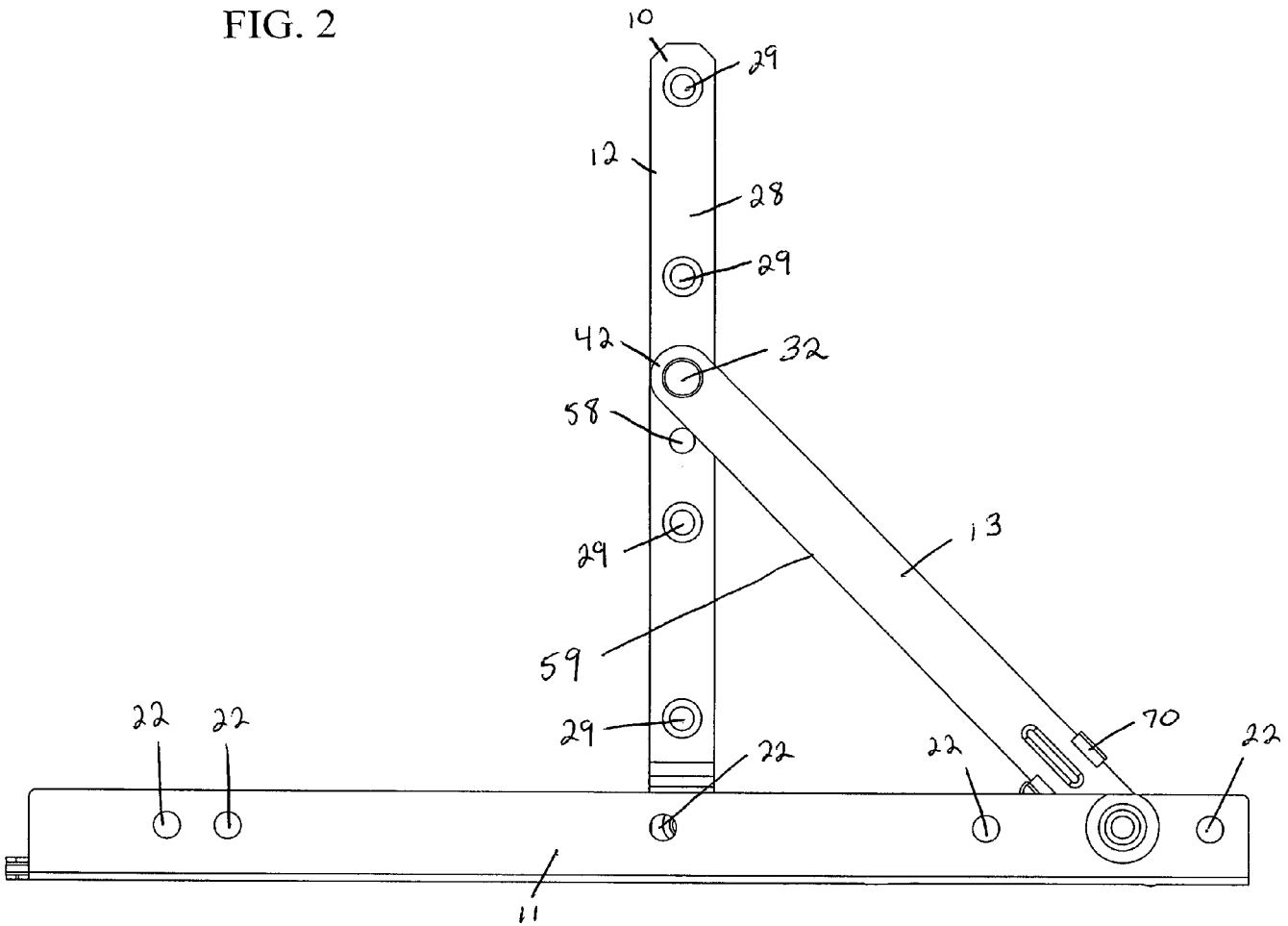
FIG. 2 is a bottom view of the casement window hinge of FIG. 1.
Figure 3:
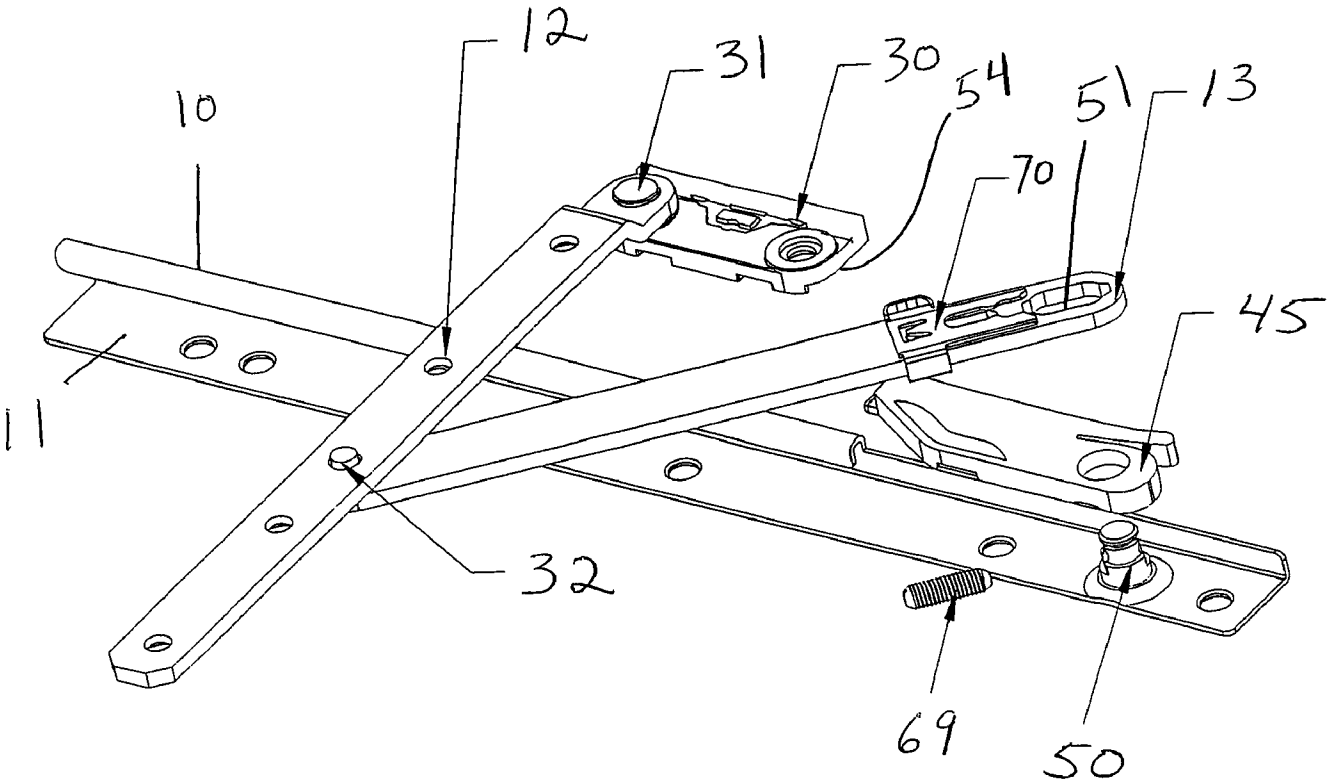
FIG. 3 is an exploded view of the casement window hinge of FIG. 1.
Figure 4:
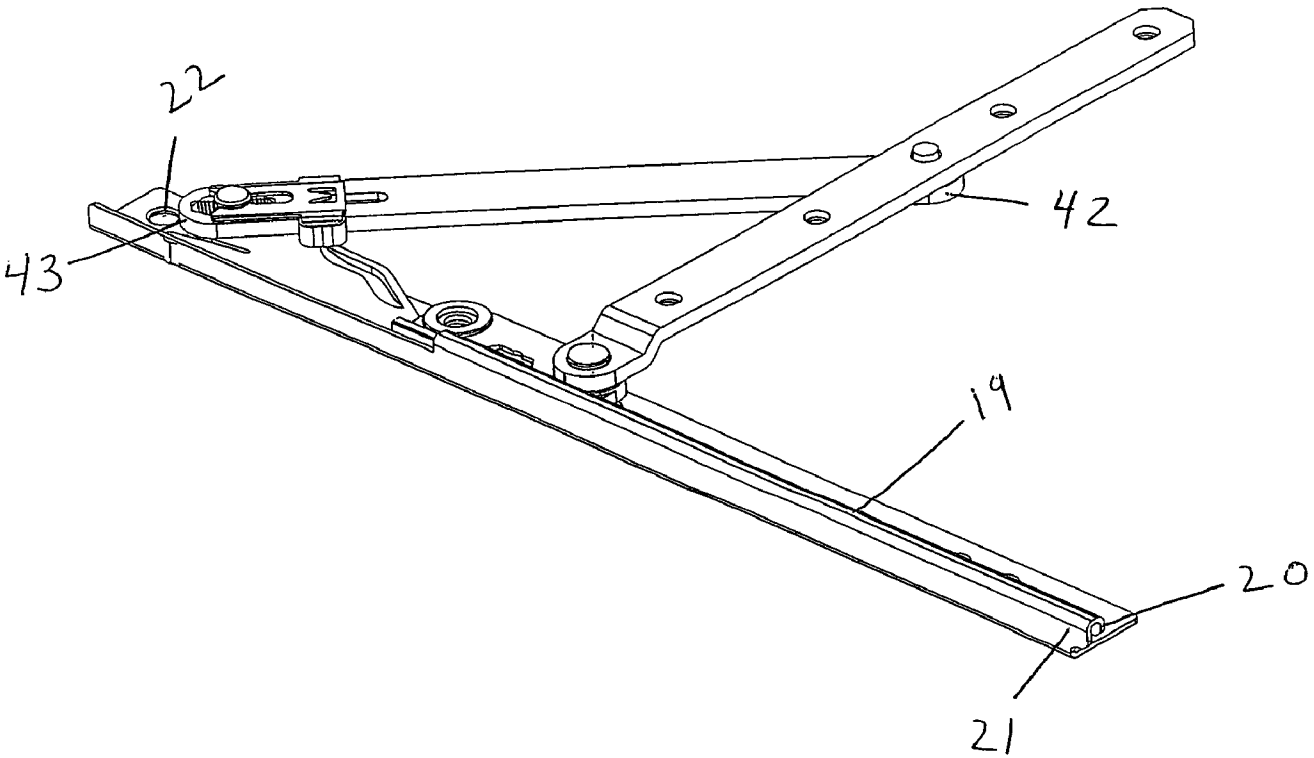
FIG. 4 is a perspective view of the casement window hinge of FIG. 1.
Figure 5:
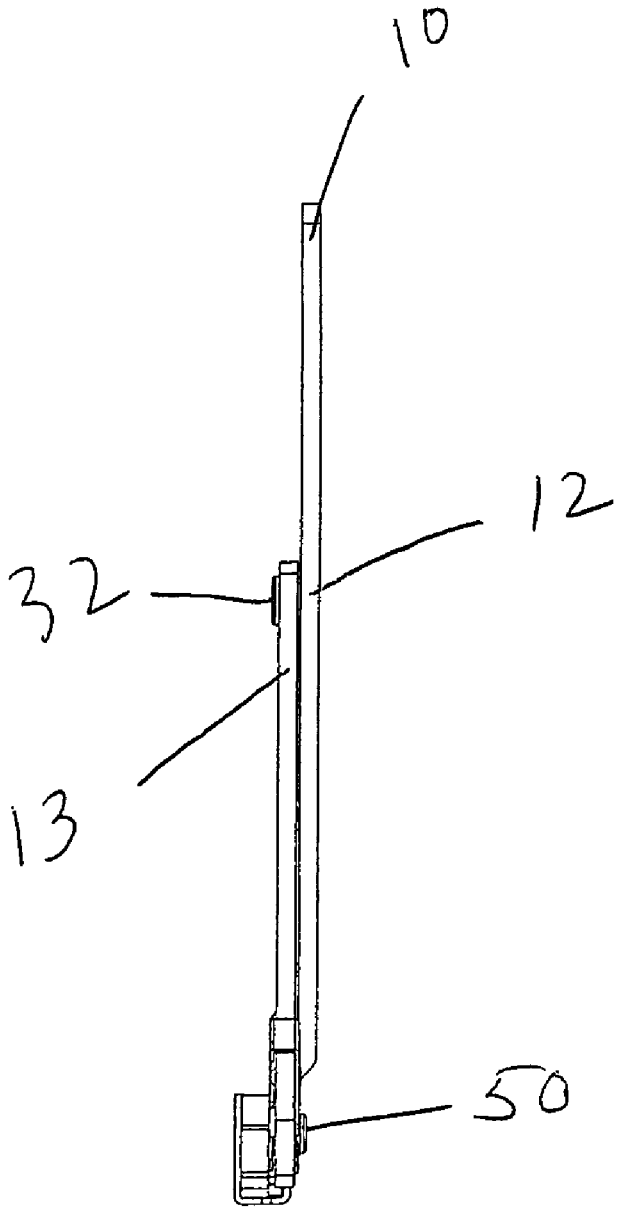
FIG. 5 is an end view of the casement window hinge of FIG. 1.

Extending from the track is a sash arm 12. The sash arm has a first end 23 and a second end 24 and a pair of sidewalls 25 and 26 joining the top 27 and bottom surfaces 28 of the sash arm. The top surface 27 of the sash arm has a number of orifices 29 that extend through the arm to the underside of the sash arm 12. These orifices are for mounting the sash arm to the window sash through the use of screws that retain the sash arm on the window frame. At the first end 23 of the sash arm 12 there is a sliding shoe 30 that is connected to the sash arm by a suitable means such as a screw or a rivet 31. The connection means 31 should permit pivotal movement of the sash arm in relation to the shoe. The sash arm 12 has another connection means 32 which can also be a screw or a rivet that connects the sash arm to the support arm 13 at any one of a number of orifices 29 in the sash arm 12. FIG. 5 shows an end view of the attached sash and support arms. The location of the connection means 32 along the sash arm for connection of the sash arm and support arm 13 can vary depending on the type of window and the amount the window is intended to be opened. The connection means 32 joining the sash arm 12 and the support arm 13 should also permit pivotal movement of the two arms. The sliding shoe 30 is preferably retained in the track 11 to prevent it from becoming separated from the track and the sliding shoe should be able to ride along the track longitudinally as necessary to permit movement of the window. However, in alternate embodiments, it may be removable so as to allow an even wider opening of the casement window when necessary. For precisely that reason, the sliding shoe 30 is secured to the sash arm 12 and can be easily fit into the rail of the track 11.

Figure 7:
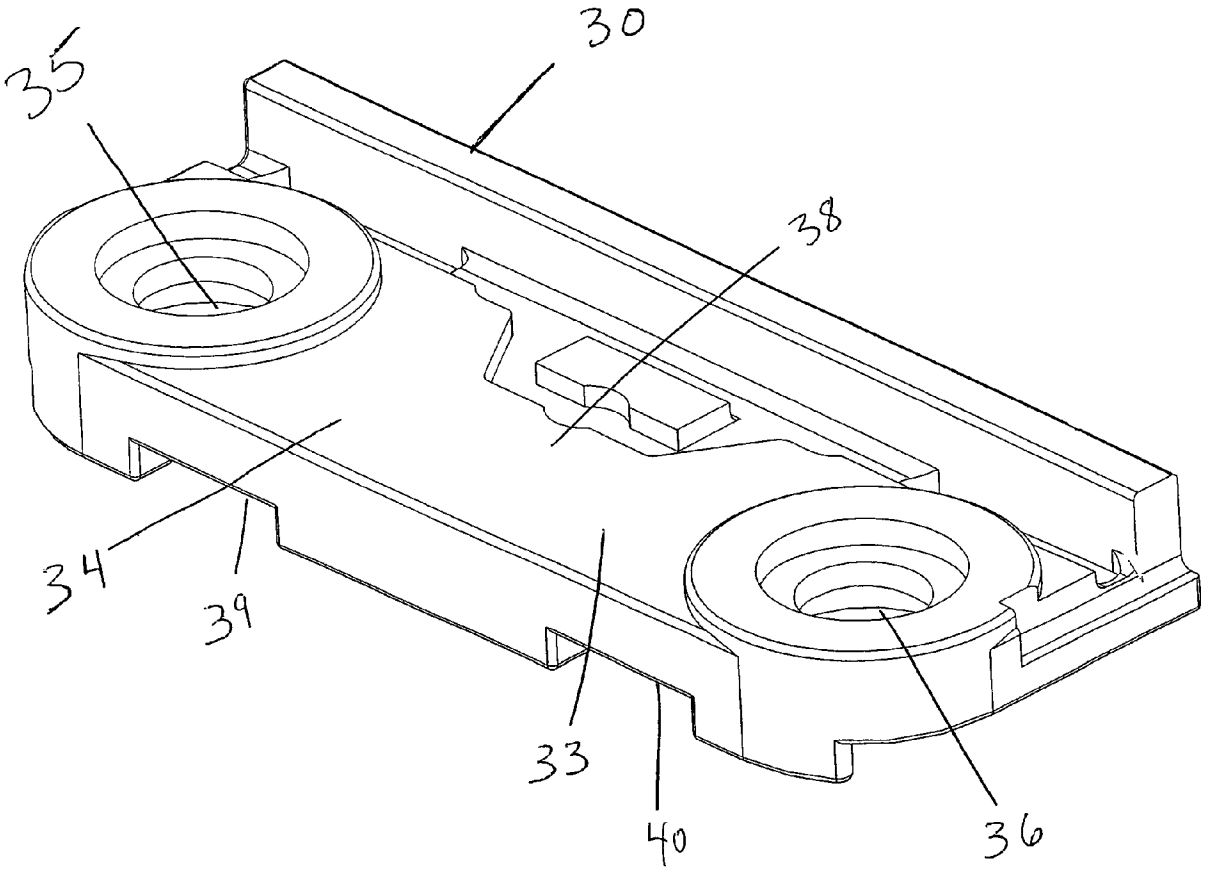
FIG. 7 is a perspective view of the sliding shoe of the hinge of the present invention.
Figure 8:
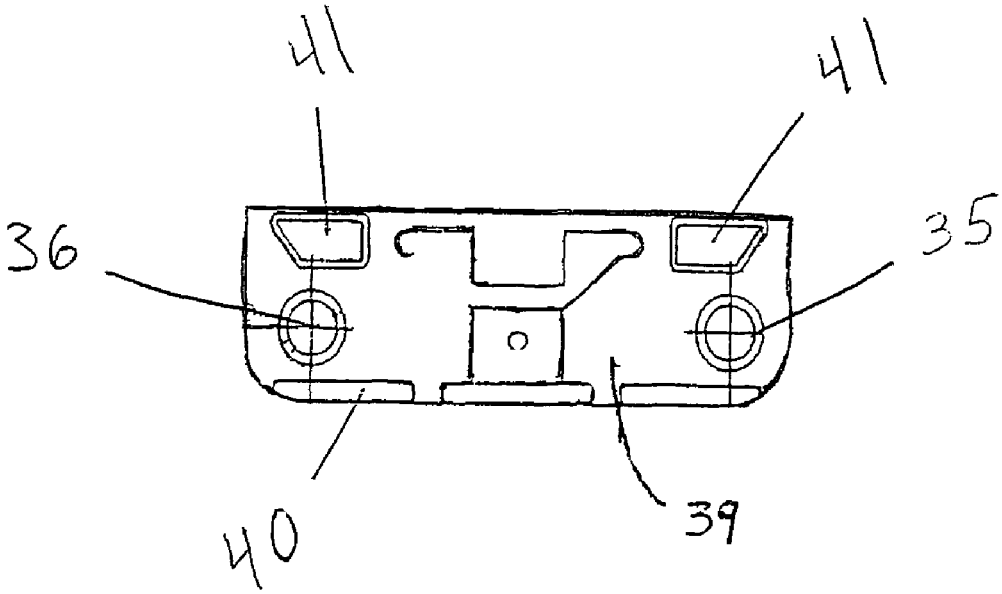
FIG. 8 is a view of the underside of the sliding shoe of FIG. 7.

As shown in FIGS. 7-8, the sliding shoe 30 of the hinge 10 of the present invention has a plate 33 that has a generally flat portion 34, which is provided with a first orifice 35 and a second orifice 36. The first of these orifices provides a means for connecting the sash arm to the sliding shoe. The second orifice 36 provides a second location for securing the sash arm to the shoe for different windows. Thus, the manufacturer can use the same hinge for a number of different windows because of the built-in variations in the hinge. These variations include the first orifice 35 and second orifice 36 in the sliding shoe 30 for securing the sash arm 12 as well as the plurality of orifices 29 in the sash arm 12 where the support arm 13 may be secured. Extending upwardly from the top surface 37 of the plate 33 of the sliding shoe 30 is a ridge or flange 38 that retains the shoe 30 in the rail 18. On the underside 39 of the plate 33 there is a first rim 40 and a second rim 41 that raise the plate above the track surface so that a rivet or bolt or screw that is inserted into either of the two orifices 35 and 36 to secure the sash arm 12 to the sliding shoe 30 does not interfere with the travel of the hinge along the track 11.

Figure 9:
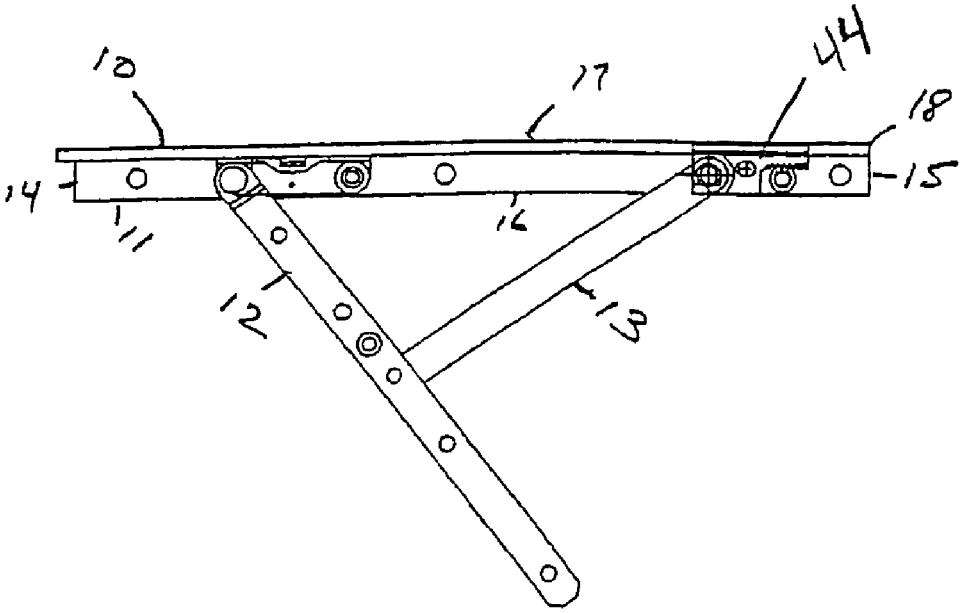
FIG. 9 is a top view of another preferred embodiment of the casement window hinge of the present invention.
Figure 10:
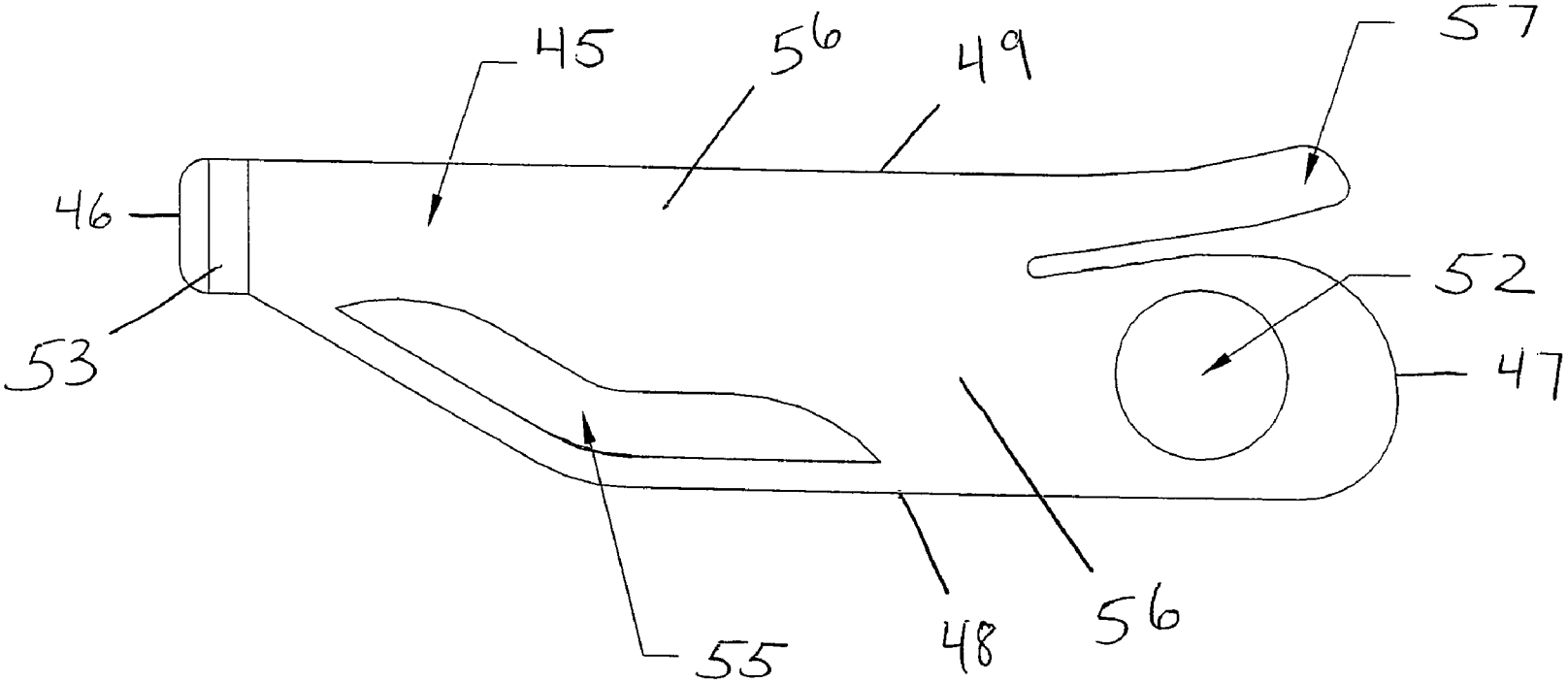
FIG. 10 is a top view of the block of the casement window hinge of FIG. 1.
Figure 11:
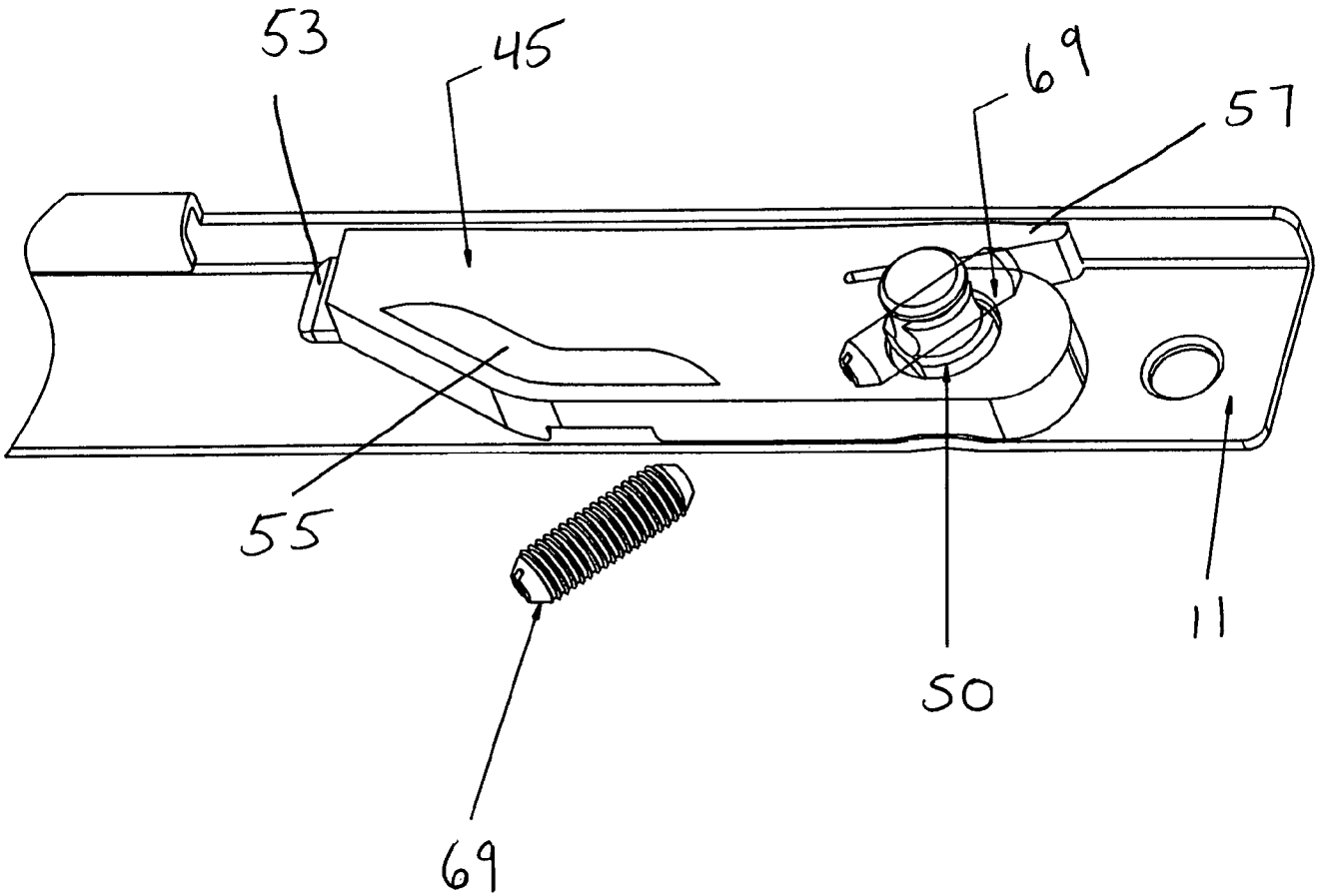
FIG. 11 is a perspective view of the connecting mechanism for attaching the support arm to the track of the casement window hinge of FIG. 1.
Figure 12:
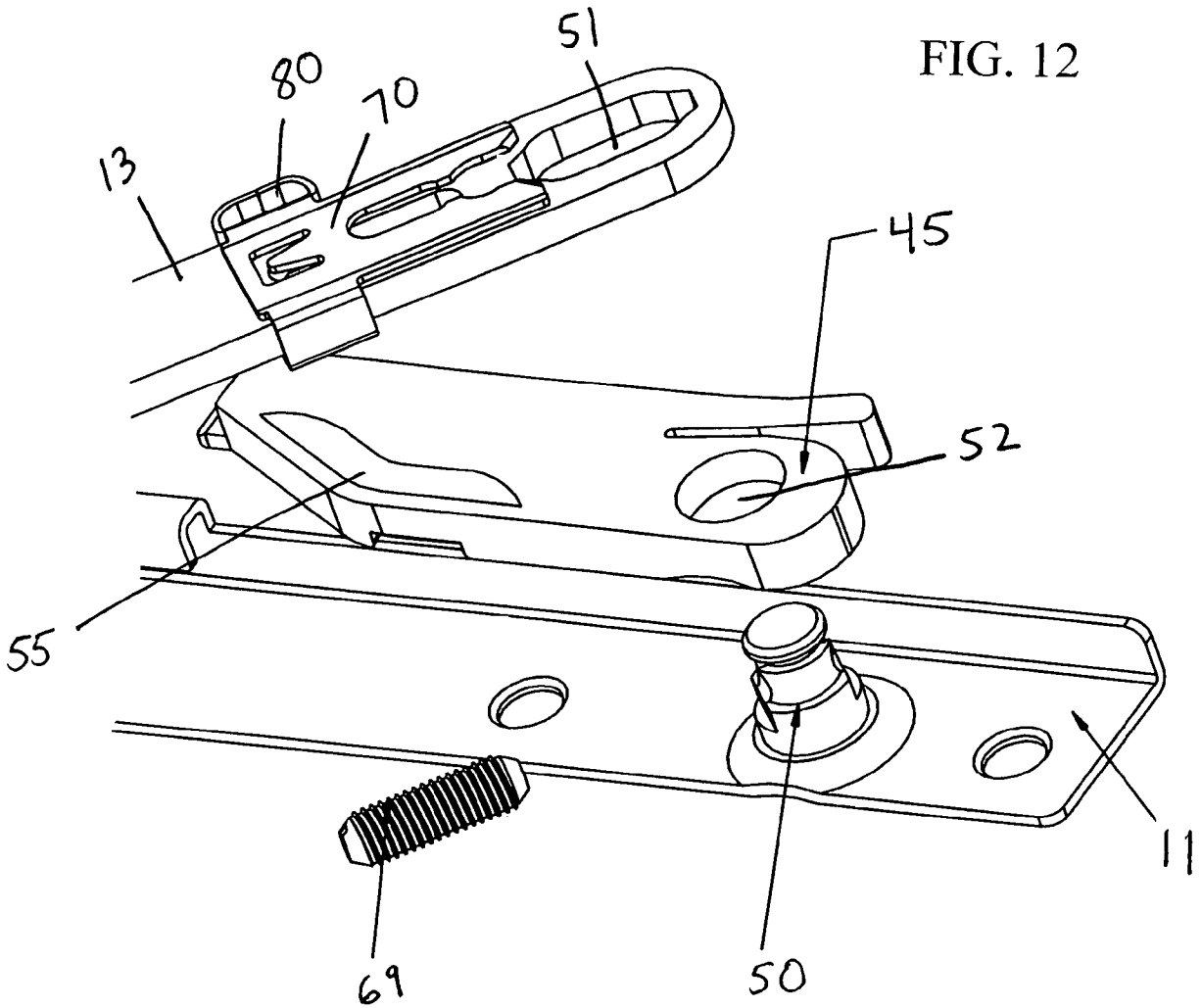
FIG. 12 is an exploded view of the connecting mechanism of FIG. 11.
Figure 13:
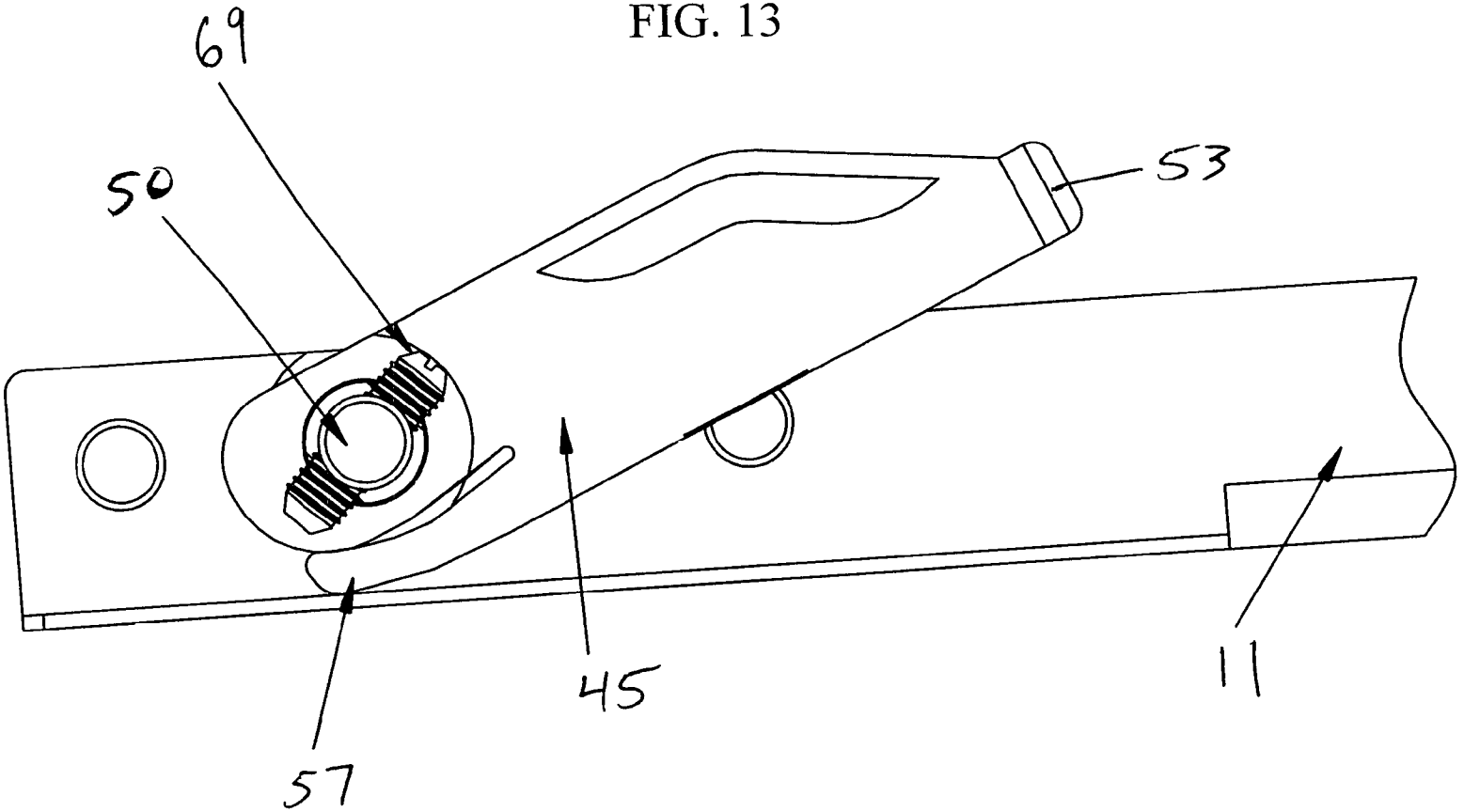
FIG. 13 is a top view of the block of the casement window hinge of FIG. 1 connected to the track and rotated approximately 45 degrees from its fixed position.
Figure 14:
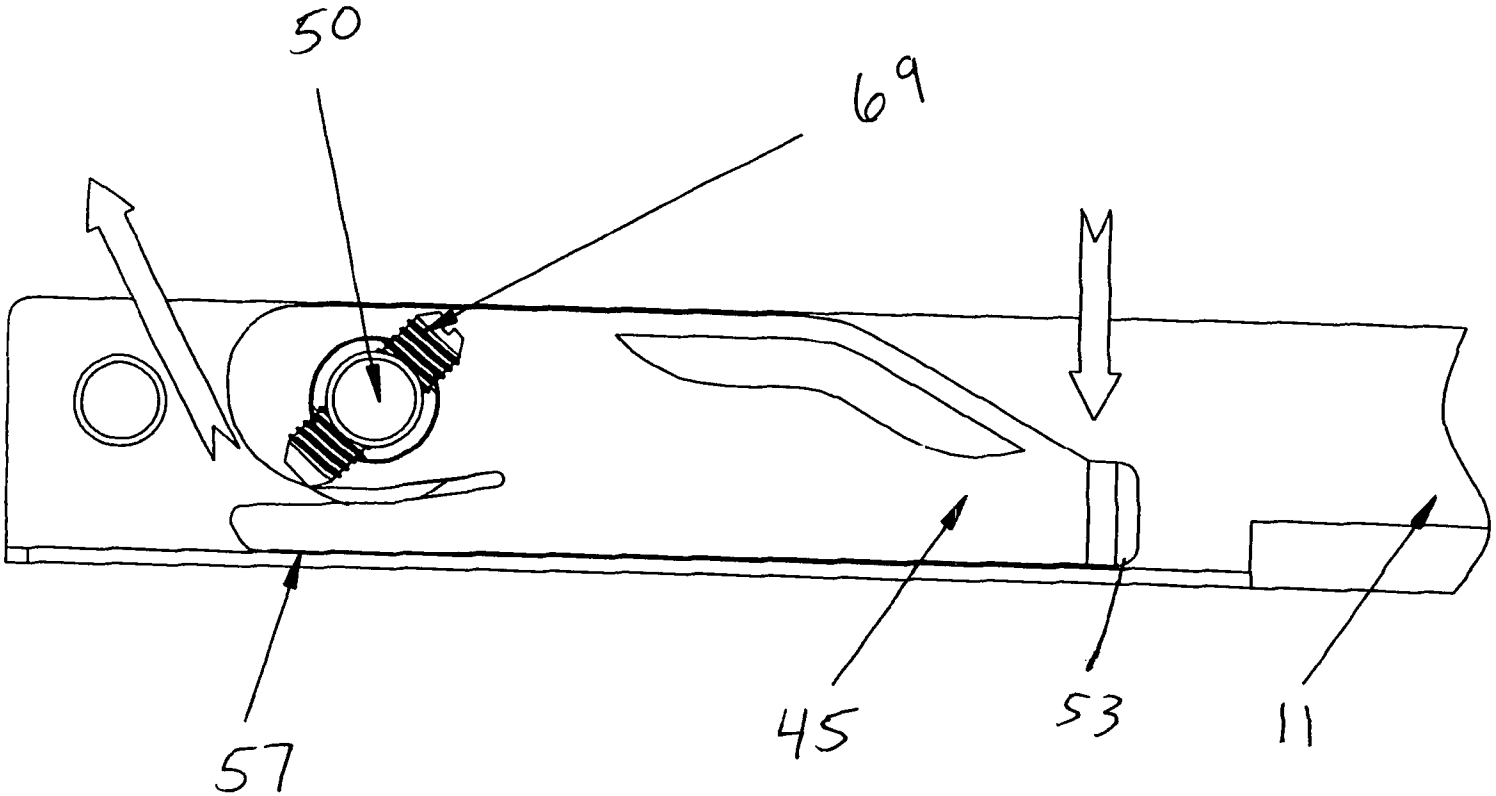
FIG. 14 is a top view of the block of FIG. 13 in its fixed position.
Figure 15:
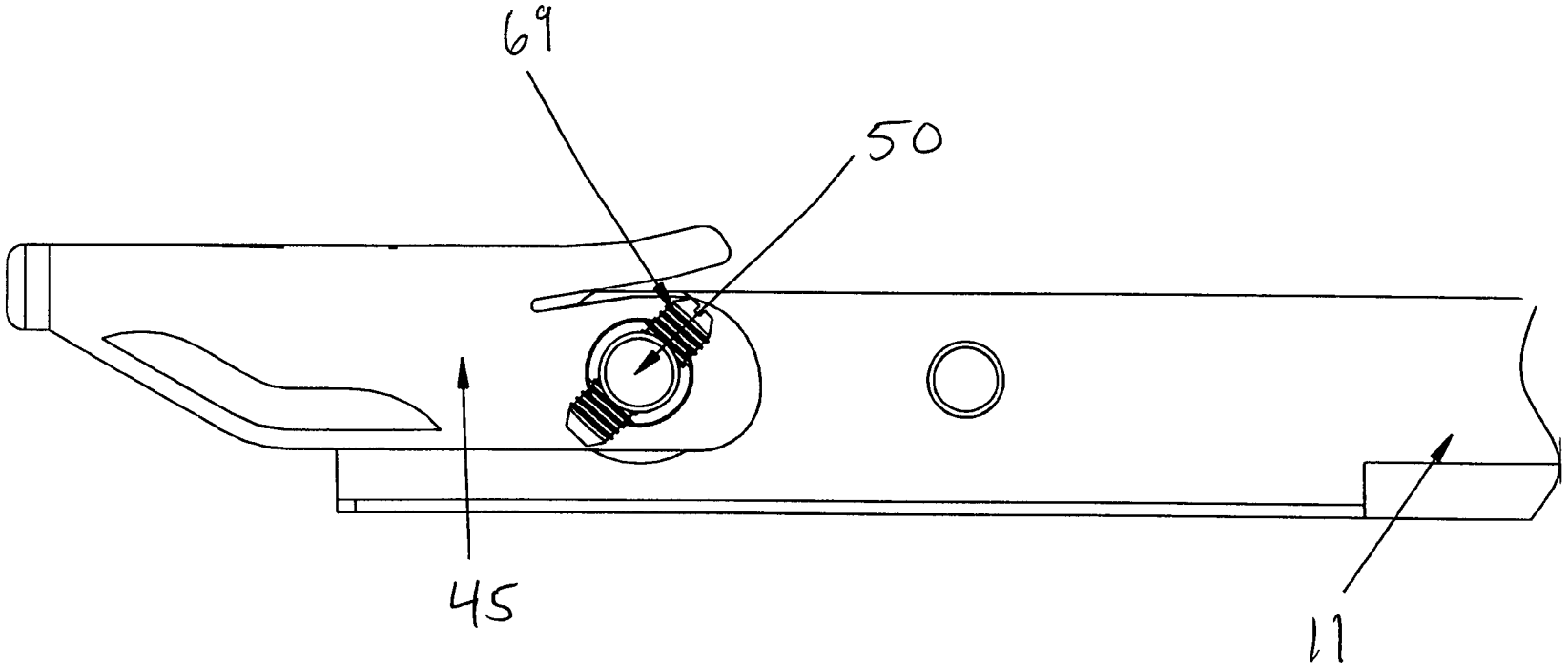
FIG. 15 is a top view of the block of FIG. 13 rotated approximately 180 degrees from its fixed position.
Figure 16:
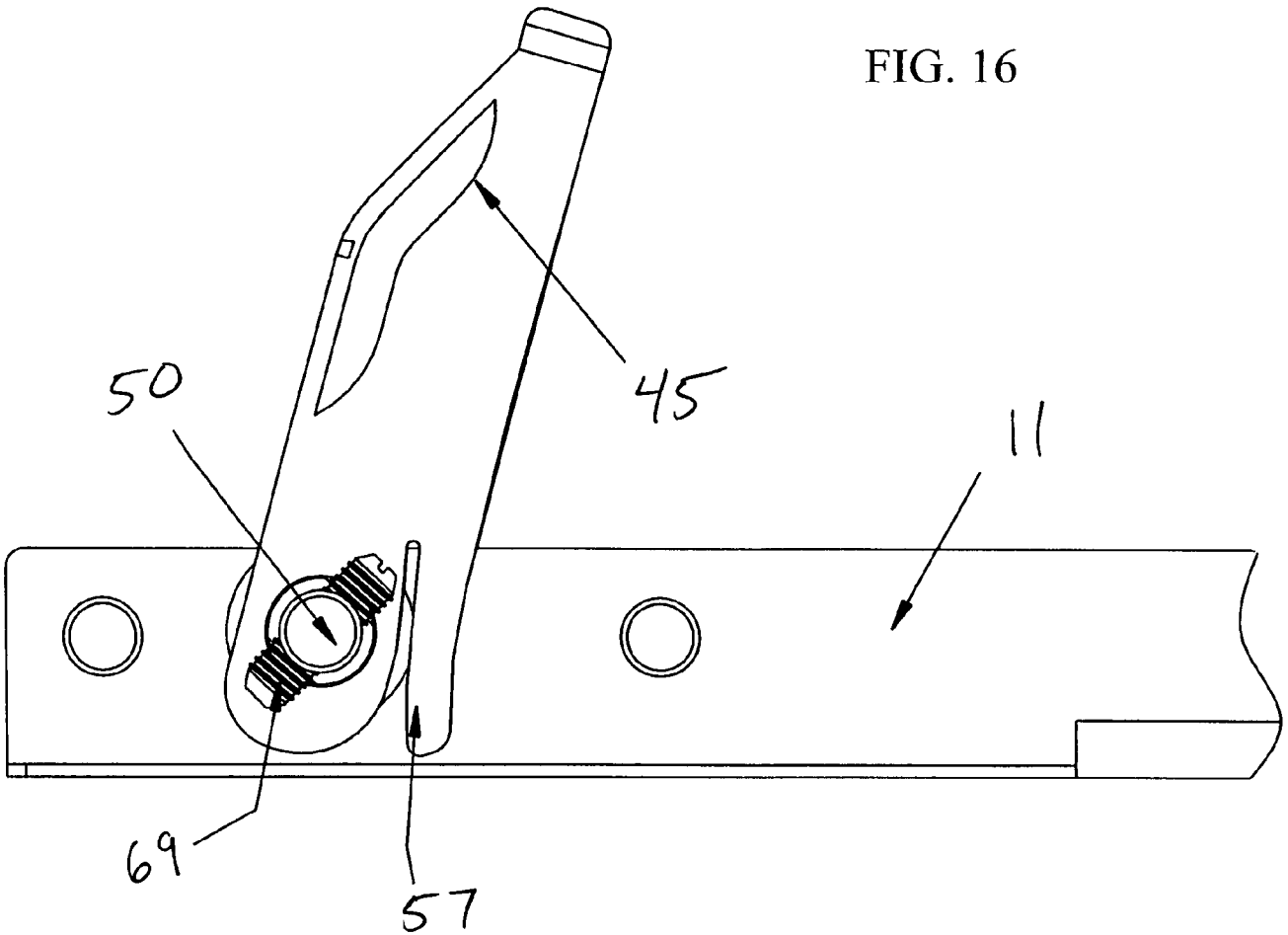
FIG. 16 is a top view of the block of FIG. 13 rotated approximately 90 degrees from its position.
Figure 17:
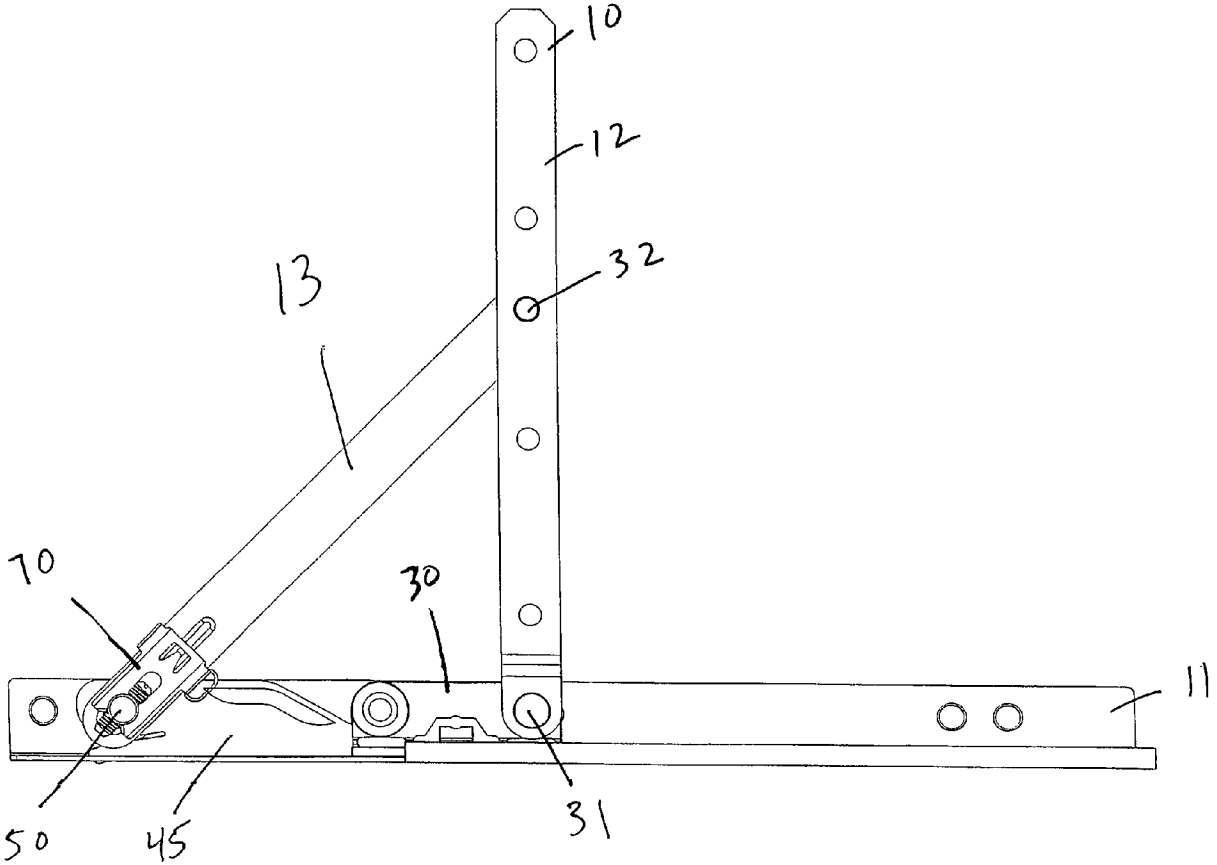
FIG. 17 is a top view of the casement window hinge of FIG. 1, where the block, in its fixed position, has impeded the sliding shoe from traveling further along the track.
Figure 18:
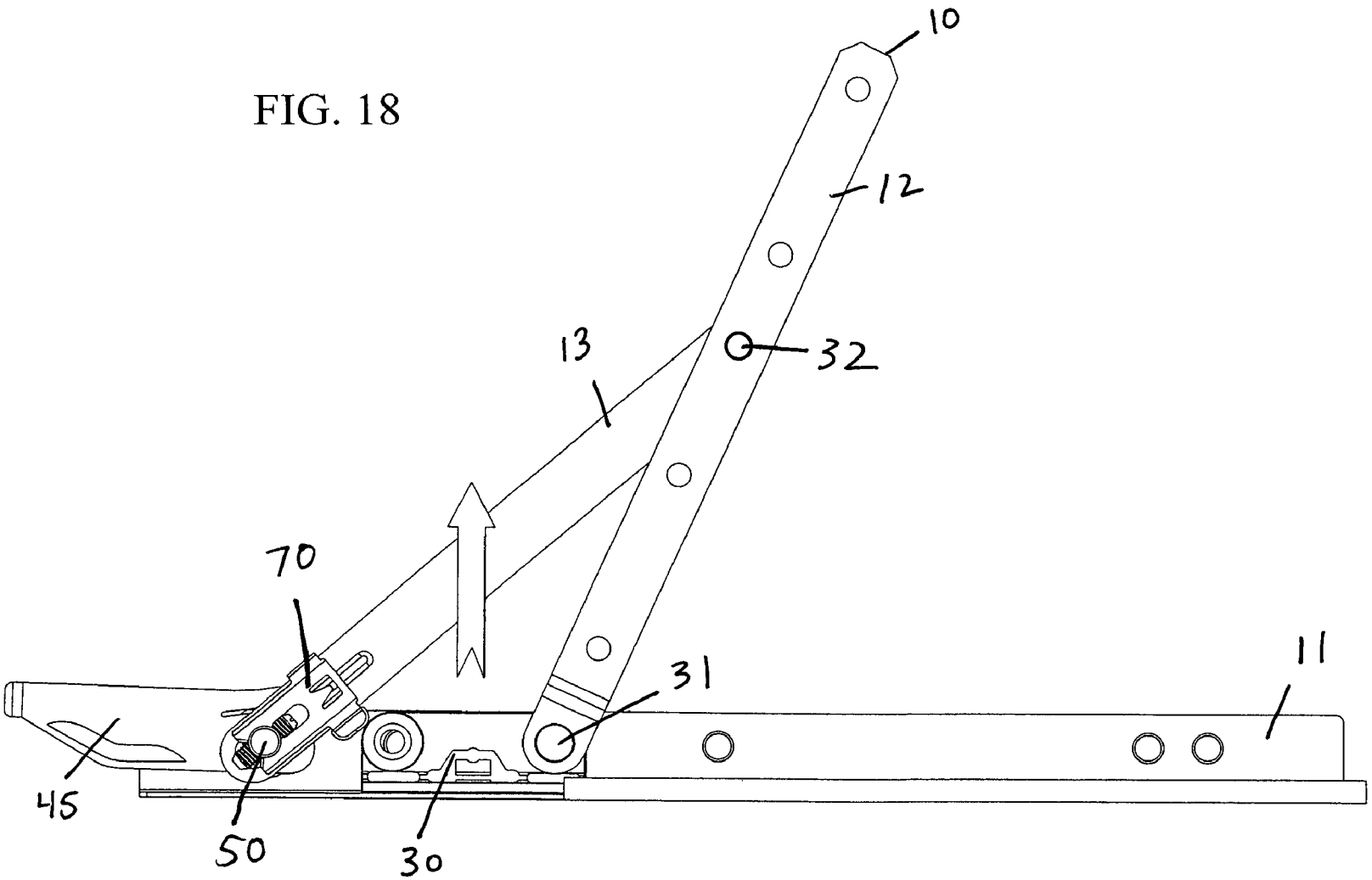
FIG. 18 is a top view of the casement window hinge of FIG. 1, where the block, rotated 180 degrees from its fixed position, has impeded the sliding shoe from traveling further along the track.
Figure 19:
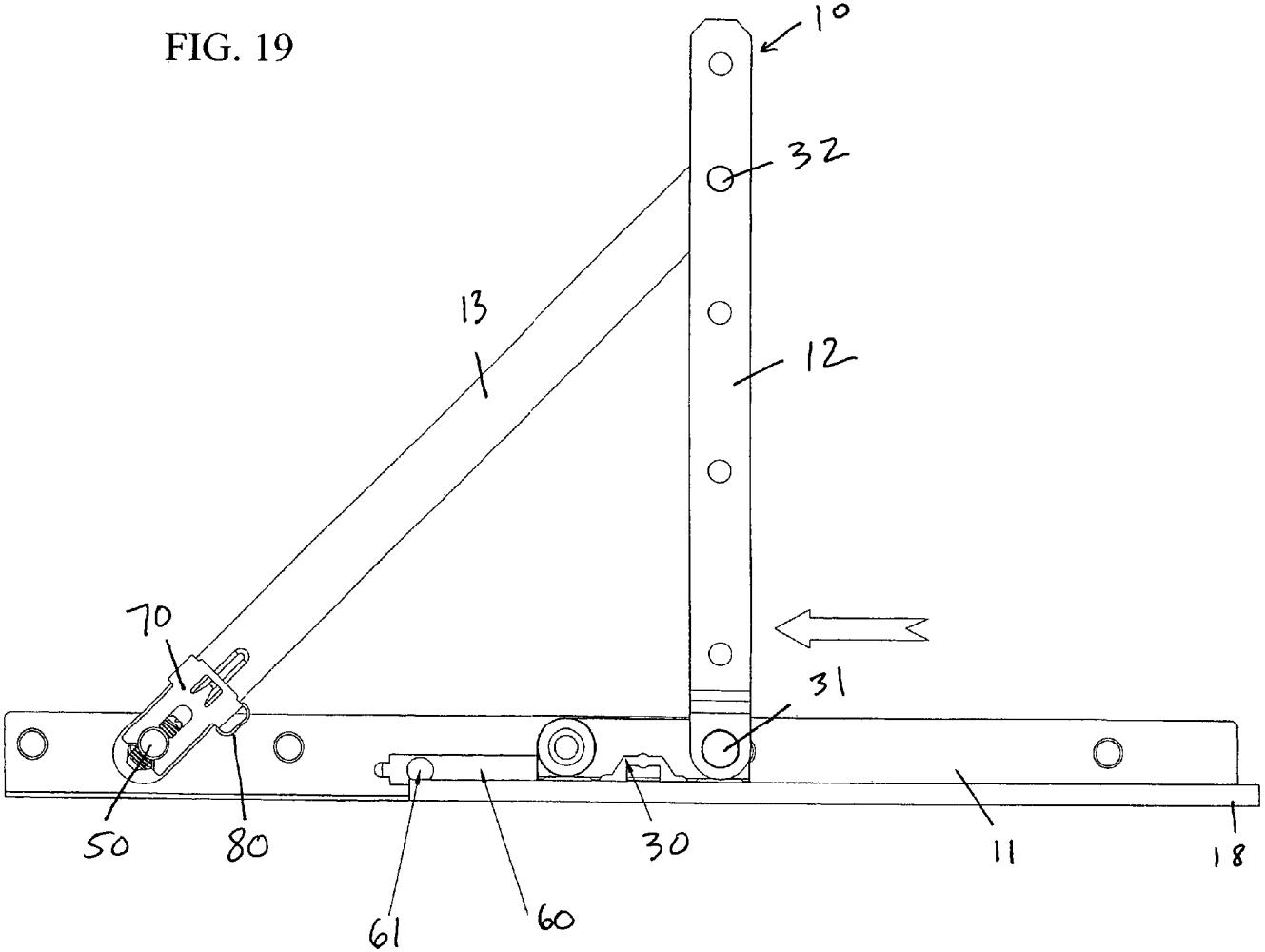
FIG. 19 is a top view of another preferred embodiment of the casement window hinge of the present invention.
Figure 20:
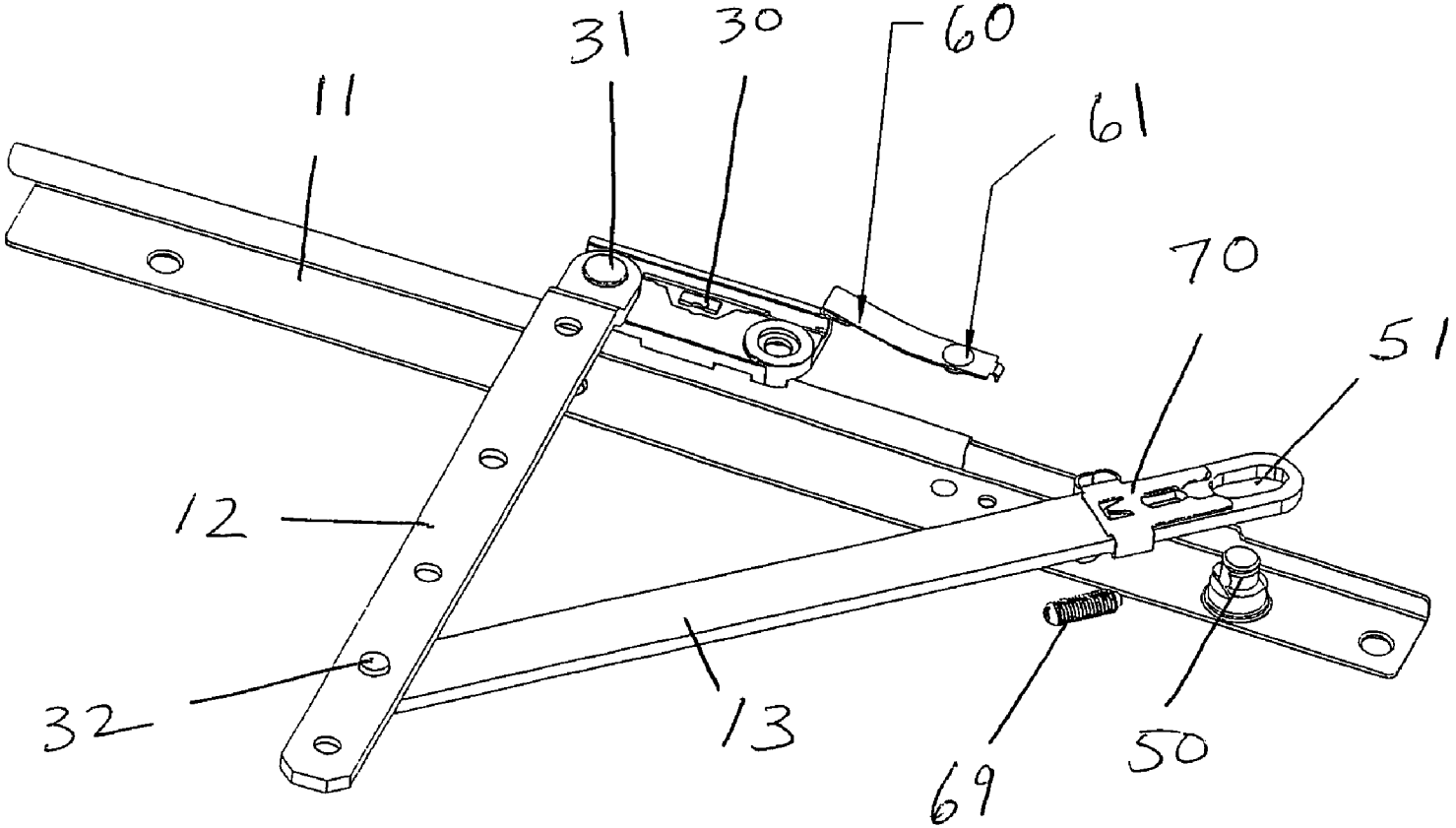
FIG. 20 is an exploded view of the casement window hinge of FIG. 19.
Figure 21:
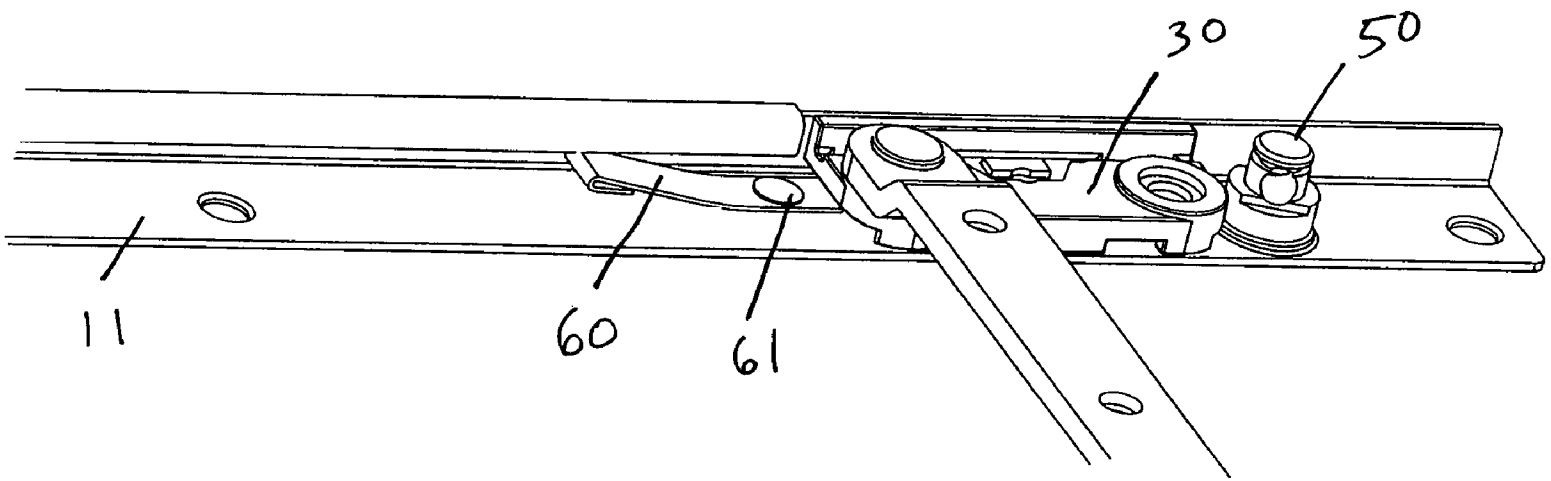
FIG. 21 is a perspective view of the sliding shoe and the detent clip of the casement window hinge of FIG. 19.
Figure 22:
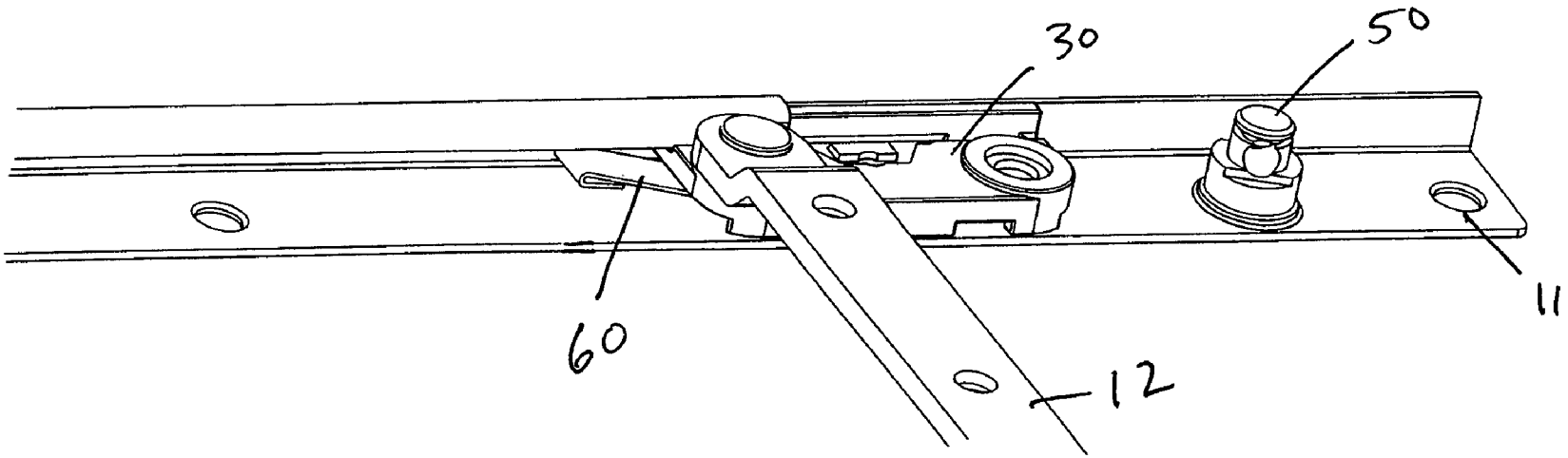
FIG. 22 is a perspective view of the sliding shoe passing over the detent clip of the casement window hinge of FIG. 19 to close the window.
Figure 23:
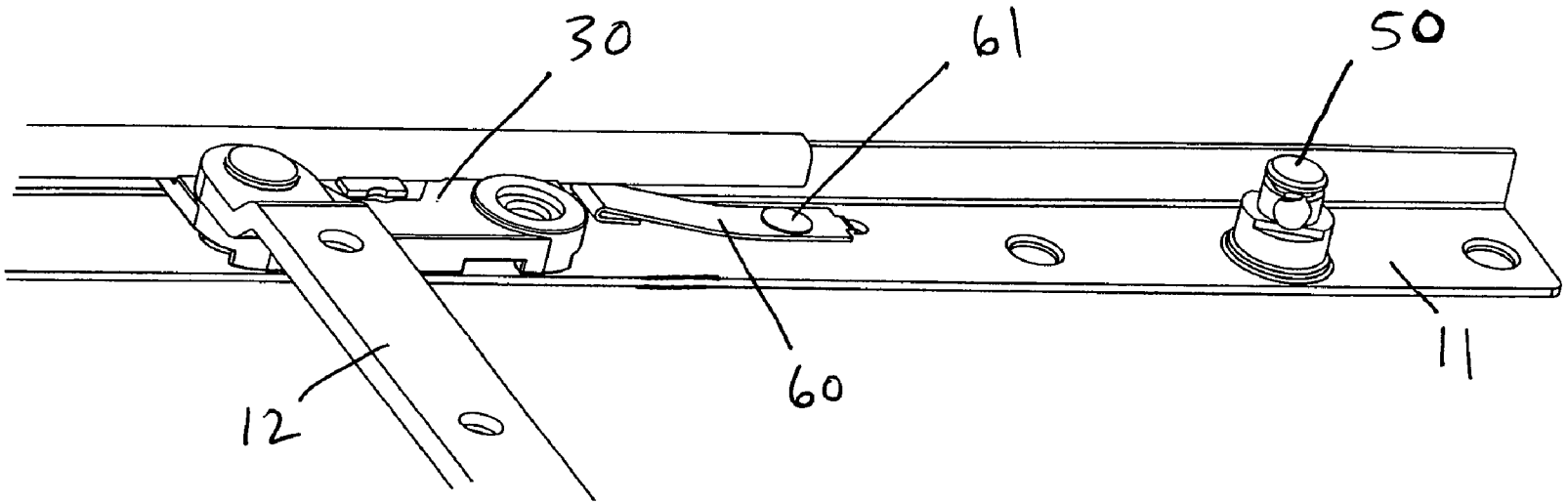
FIG. 23 is a perspective view of the sliding shoe passing further over the detent clip of the casement window hinge of FIG. 19 to close the window.
Figure 24:
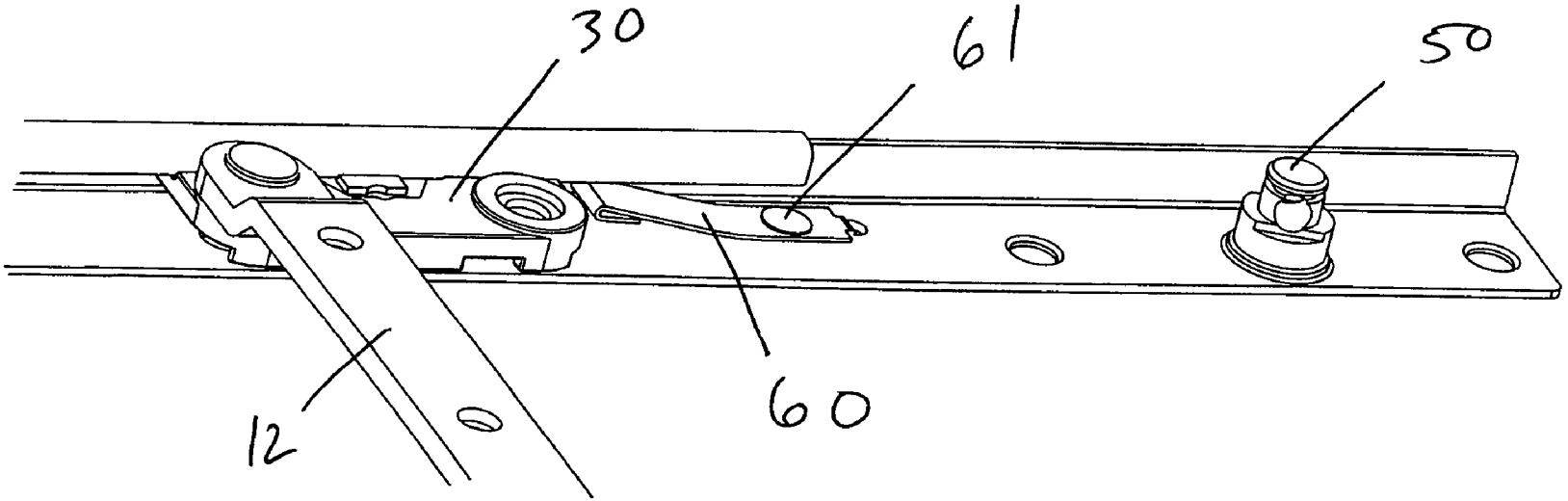
FIG. 24 is a perspective view of the sliding shoe approaching the detent clip of the window casement hinge of FIG. 19 in order to open the window.
Figure 25:
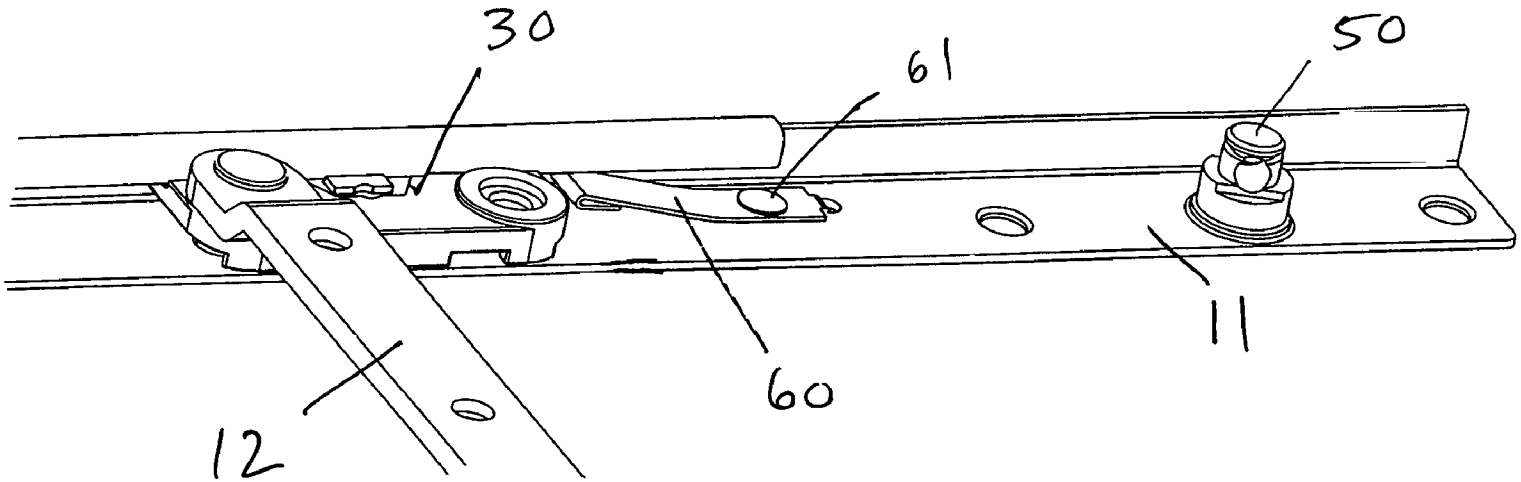
FIG. 25 is another perspective view of the sliding shoe interacting with the detent clip of the casement window hinge of FIG. 19.
Figure 26:
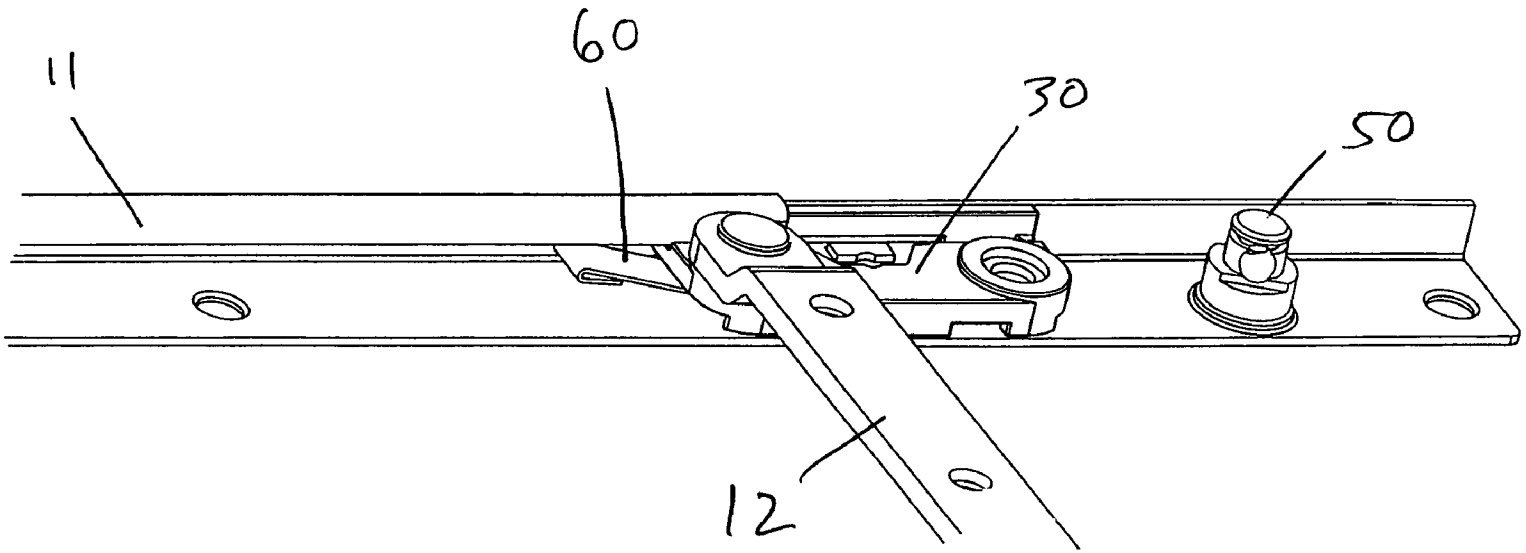
FIG. 26 is another perspective view of the sliding shoe passing over the detent clip of the casement window hinge of FIG. 19 in order to open the window.
Figure 27:
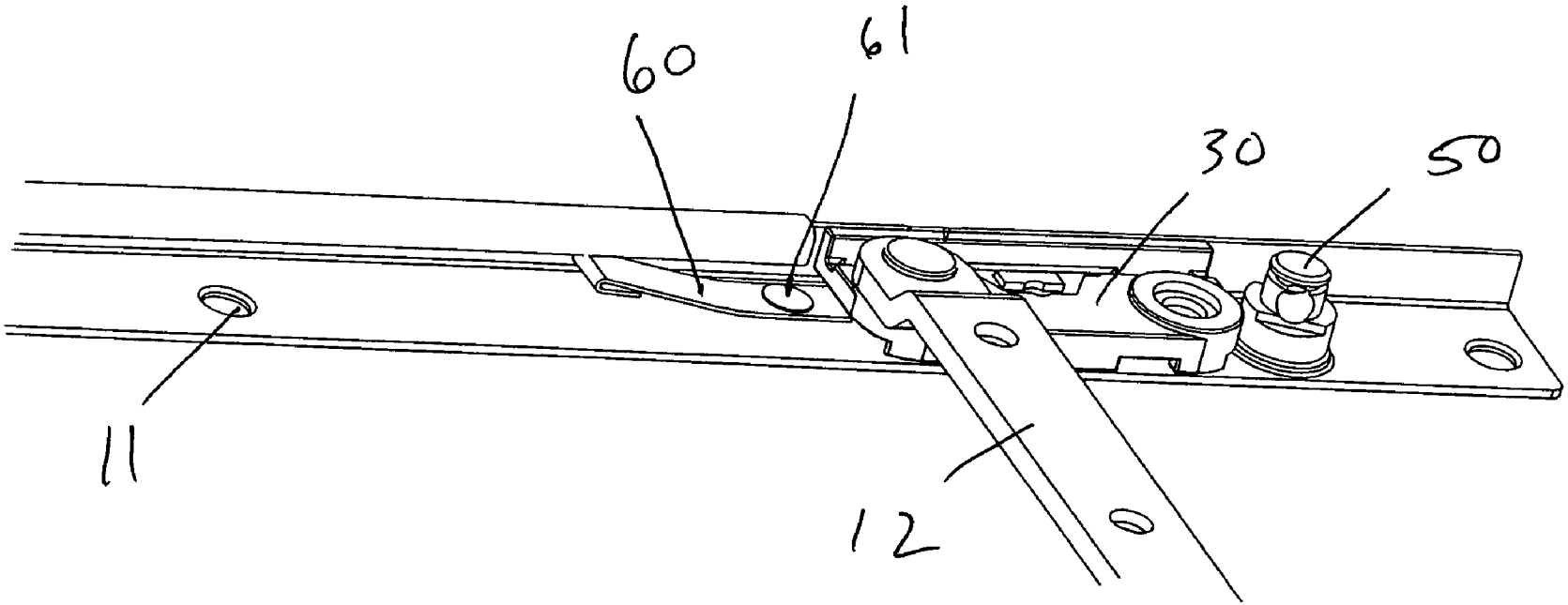
FIG. 27 is a perspective view of the sliding shoe and detent clip of the casement window hinge of FIG. 19 with the window in an open position.
Figures 28, 29, 30:
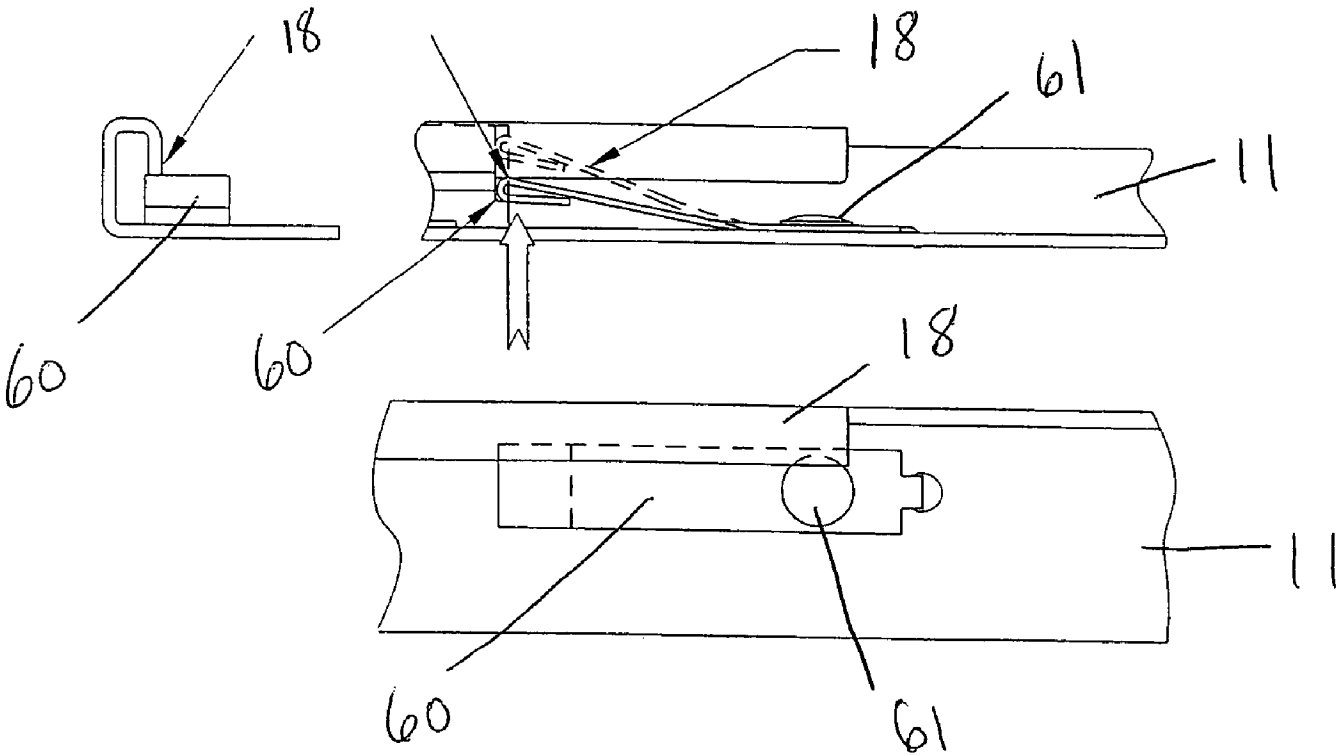
FIG. 28 is a side view of the detent clip's interaction with the rail of the casement window hinge of FIG. 19.
FIG. 29 is an end view of the detent clip's interaction with the rail of the casement window hinge of FIG. 19.
FIG. 30 is a top view of the detent clip of the casement window hinge of the present invention.
Figure 44:
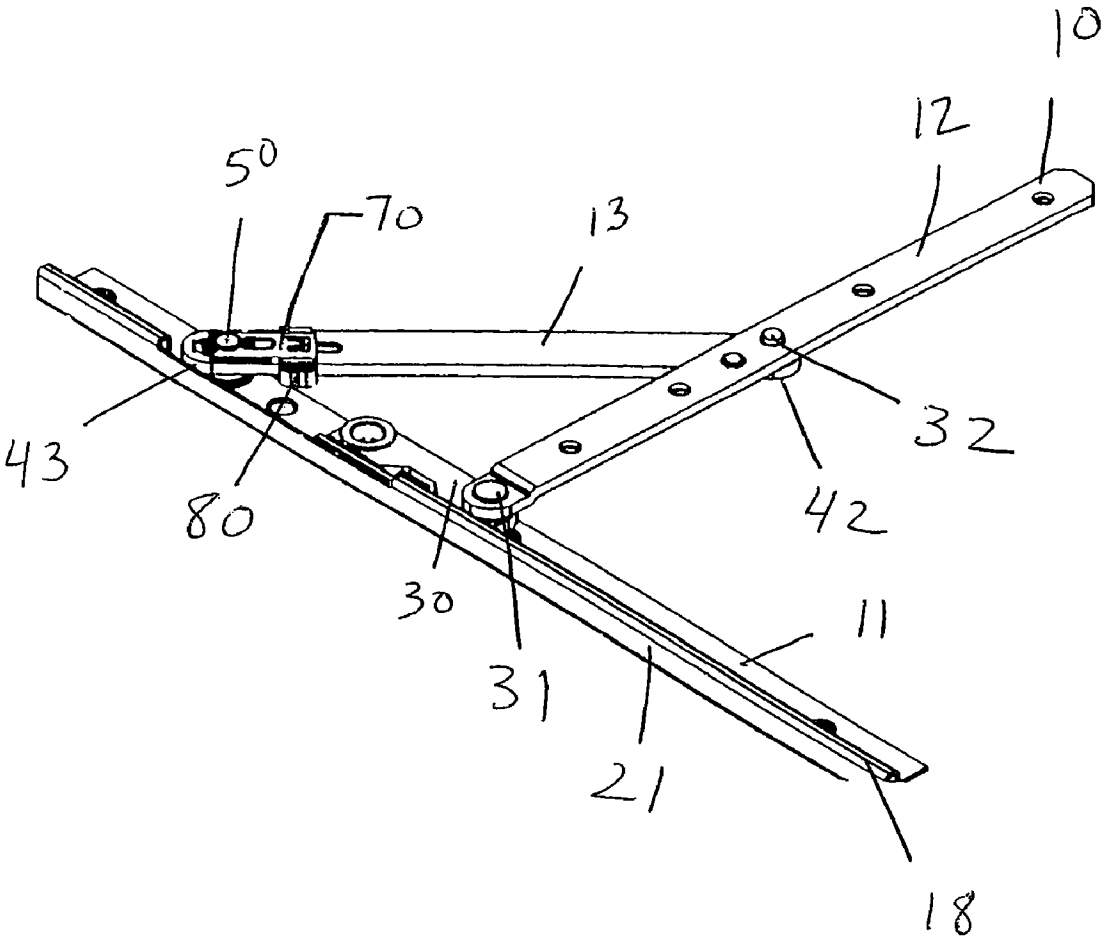
FIG. 44 is a perspective view of another preferred embodiment of the casement window hinge of the present invention that does not utilize a second shoe, block or detent clip.

One end 42 of the support arm 13, as noted above, is pivotally connected to the sash arm 12. Although FIG. 44 shows an embodiment where the support arm 13 is pivotally connected directly to the track 11 itself, in one embodiment, illustrated by FIG. 9, the other end 43 of the support arm 13 is connected to a second shoe or gear rack 44. The second shoe 44 has a generally fixed position on the track and permits the second end 43 of the support arm 13 to pivot about a connecting mechanism 31, like a pin or stud, during opening and closing of the window. FIGS. 10-18 illustrate another embodiment, where the second end 43 of the support arm is connected to a block 45, which is generally flat, much like the sliding shoe 30. As seen in FIG. 10, the block 45 may be of any practicable shape, but generally has a first 46 and second end 47, as well as two sidewalls 48 and 49. The block 45, like the second shoe, has a generally fixed position on the track and permits the second end 43 of the support arm 13 to pivot about a connecting mechanism 31 during opening and closing of the window. It may be secured to the support arm 13 by any practicable means. However, in the preferred embodiment, the block 45 is fixed onto a stud 50 which reeves through orifices in the support arm 51, the block 52 and the track 22.

The block also has at its first end has a lip or flange 53 for receiving the mating end 54 of the sliding shoe 30 and restricting its travel along the track 11. However, in a preferred embodiment, although the block 45 is generally fixed on the track, it has the ability to pivot along the axle of the stud or other connecting mechanism 50 in order to allow the casement window, when necessary, to be opened up wider, without detaching the sash arm 12 from the track 11. FIGS. 13-18 show how a user may preferably pivot the block 45 through use of a gripping mechanism, preferably a groove 55 on the block's surface 56, which can be grasped in order to lift the block 45 and rotate it around the axle. Although this block may be of any practical shape or configuration, in the preferred embodiment, it contains a detent in order to prevent the block from rotating around the pin back and forth between the open and closed positions. In the preferred embodiment, this detent is a resilient arm 57 along the second sidewall 49 of the block, which bends inward upon the application of the proper amount of force by the user and permits the block's rotation up to 180 degrees, at which point the second side member 21 of the rail 18 of the track 11 prohibits further pivoting of the block 45. However, because the resilient arm 57 is strong enough to arrest the rotation of the block 45 in the absence of a user's forcible rotation of the block 45, the resilient arm 57 acts as a detent that prevents the block 45 from spontaneously rotating from an open position to a closed position.

Although a lip or flange 53 exists on the block 45 for reception of the sliding shoe 30, the block 45 in an open position may still restrict the sliding shoe's travel along the track 11, by obstructing its path along the track. However, the further the block 45 is rotated along the axle, the longer the sliding shoe 30 and sash arm 12 can travel unrestricted, and, thus, the wider the window may be opened. In another embodiment, the support arm 13 of the present invention is pivotally connected to neither a sliding shoe nor a block, but is merely connected to the track 11 itself, via some sort of connecting mechanism 50, such as a pin, or a stud or bolt of some sort.

In order for the casement window hinge 10 of the present invention to be able to function properly in inhibiting a user's ability to normally open the casement window wider than a certain permissible distance, there are several means of inhibiting the sliding shoe's movement along the track of the hinge. In the first instance, the support arm 13 of the present invention is attached by a connective mechanism 50 to the track 11 at the end 15 opposite the sliding shoe's connection to the track. This inhibits a user from being able to detach the sash arm 12, support arm 13, and/or the sliding shoe 30 from the track 11. On the other side, there must be something to impede the sliding shoe's travel along the track when the casement window is being opened, so that the window does not open too far. The embodiment discussed above, with the block 45 has already achieved this by prohibiting the sliding shoe's travel when it makes contact with the block. However, in alternate embodiments, all other practicable means of restricting the sliding shoe's travel may be utilized.

One example of a practicable method of achieving this is by having at least one stopper, in the form of a protrusion 58 on the first sidewall 59 of the sash arm 12. In between the orifices 29 of the sash arm 12 there is a cylindrical-shaped protrusion 58 which makes contact with the side wall 59 of the support arm 13 and restricts the sash arm's movement at any open angle desired (for example, 90 degrees). The stopper 58 may be of any shape and made of any material that would achieve the desired restriction of the sash arm 12. A screw, pin or stud attached to the bottom surface 28 of the sash arm 12 or even reeved through an orifice 29 in the sash arm 12 is even a possible means of creating a stopper 58.

Another example, shown in FIGS. 19-30, of a possible stopping mechanism is a detent clip 60, that is, a clip that is mounted, by a rivet or other attaching mechanism 61, onto the track 11 of the hinge 10. The detent clip 60 generally has two ends 92 and 93. The first end of the clip is attached to the track by the rivet 61, but in the preferred embodiment, the attaching mechanism 61, may be removed from the orifice 22 in the track 11 and be placed in another orifice 22 in the track 11 so that the detent clip 60 may be moved along the track as the user desires. The second end 93 of the detent clip 60, is generally raised with relation to the track 11, so that it stops the travel of the sliding shoe 30 along the track 11. However, the sliding shoe 30 may pass over the detent clip 60 back and forth when a user presses down on the raised end 93 of the clip 60, so as to lower it and allow the shoe's travel along the track 11. The detent clip 60 on the track 11, therefore restricts the sliding shoe 30 passing over its raised end 93, which catches the sliding shoe 30 in its travel along the track 11 in both directions. These are only two of many possible examples of useful stopping mechanisms to restrict the ability of the sliding shoe 30 to travel freely along the track.

Figure 31:
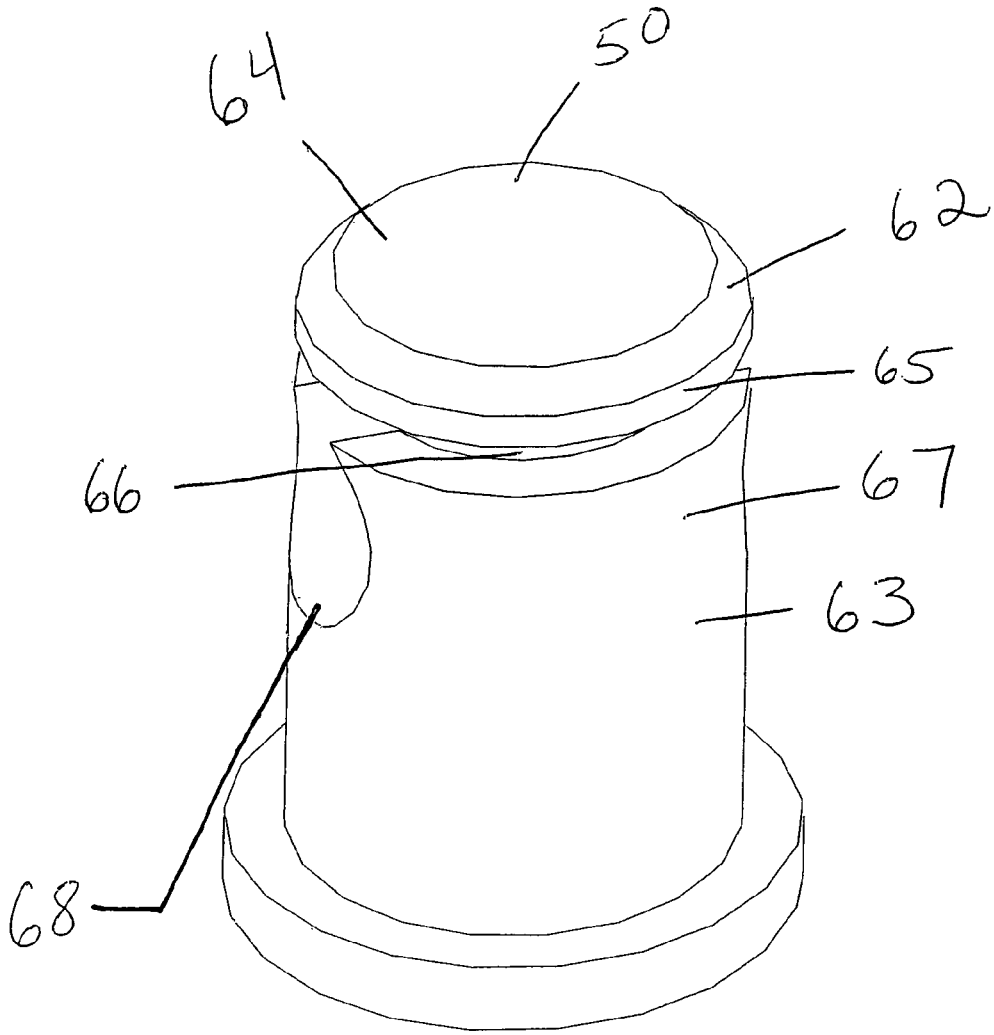
FIG. 31 is a side perspective view of the stud of the connecting mechanism that attaches the support arm to the track in a preferred embodiment of the casement window hinge of the present invention.
Figure 33:
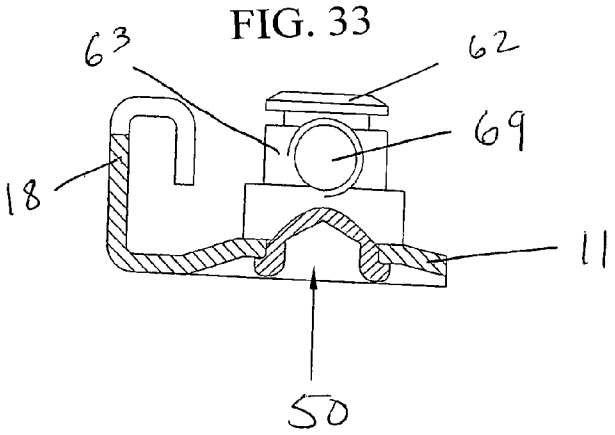
FIG. 33 is a side cross section view of the connecting mechanism of FIG. 32.
Figure 32:
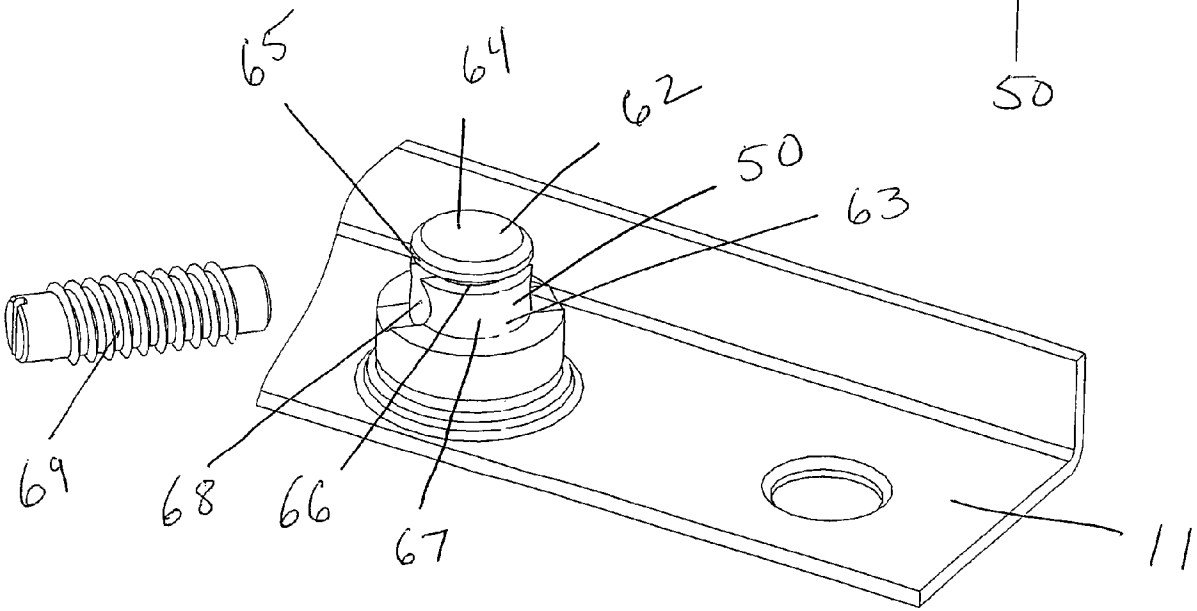
FIG. 32 is a perspective view of the connecting mechanism of the preferred embodiment of the casement window hinge of the present invention with the removable screw outside the orifice in the stud.
Figure 34:
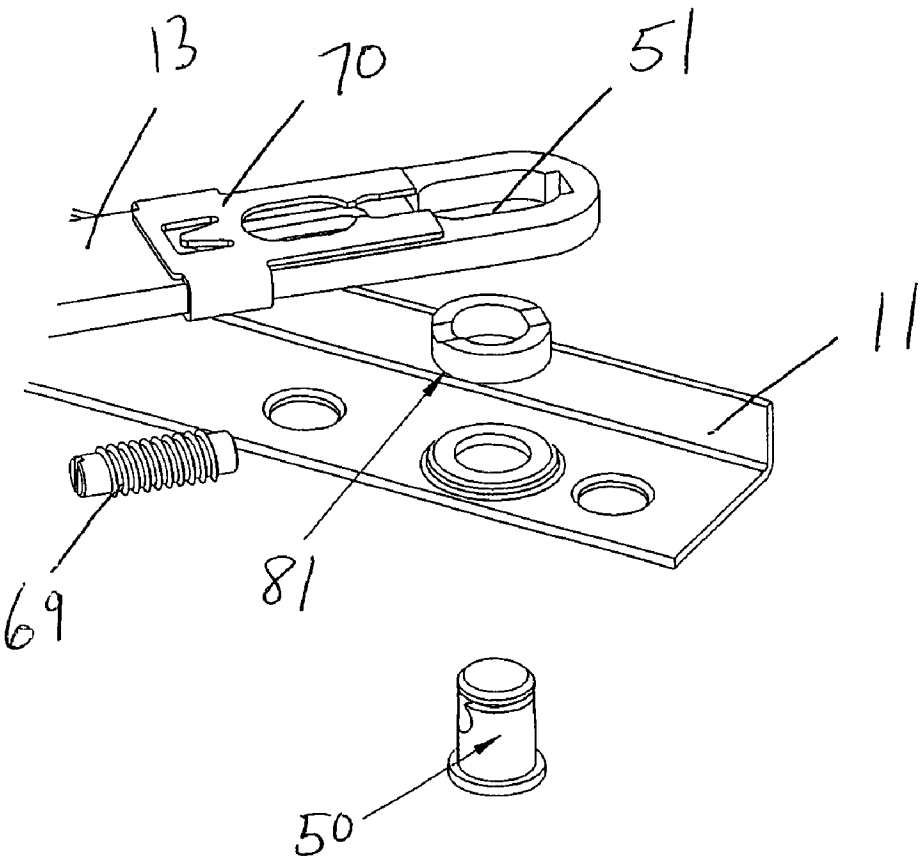
FIG. 34 is an exploded view of the connecting mechanism of FIG. 32 with the support arm also shown.
Figure 35:
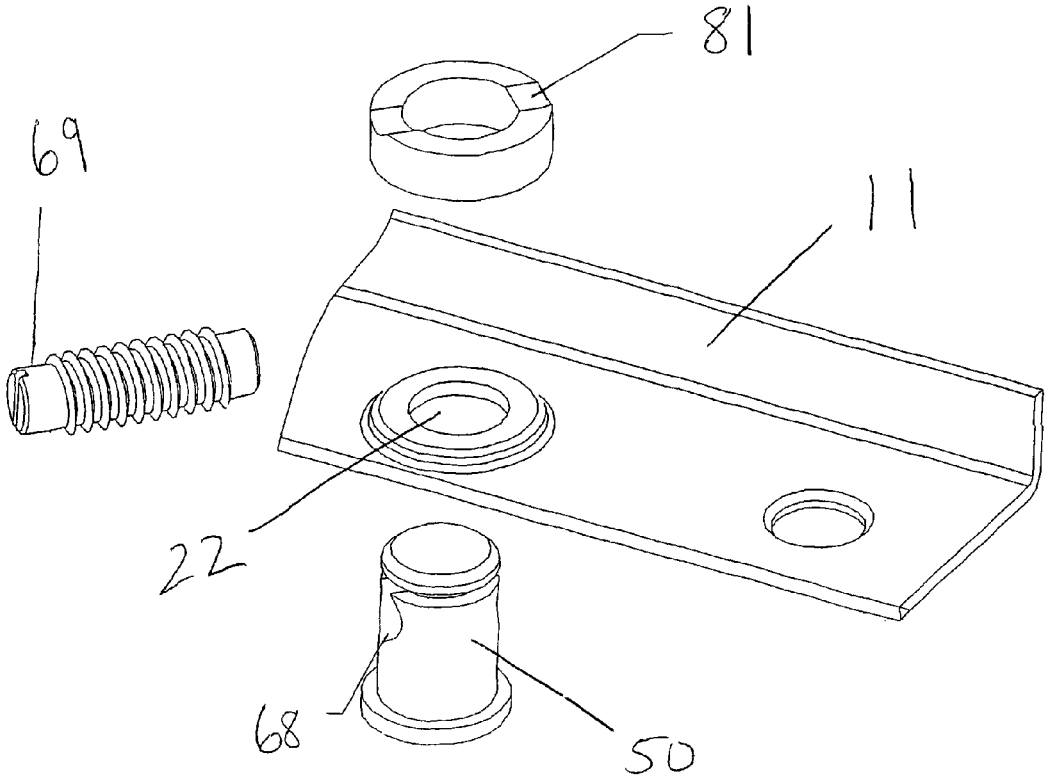
FIG. 35 is an exploded view of the connecting mechanism of FIG. 32 without the support arm.
Figure 36:
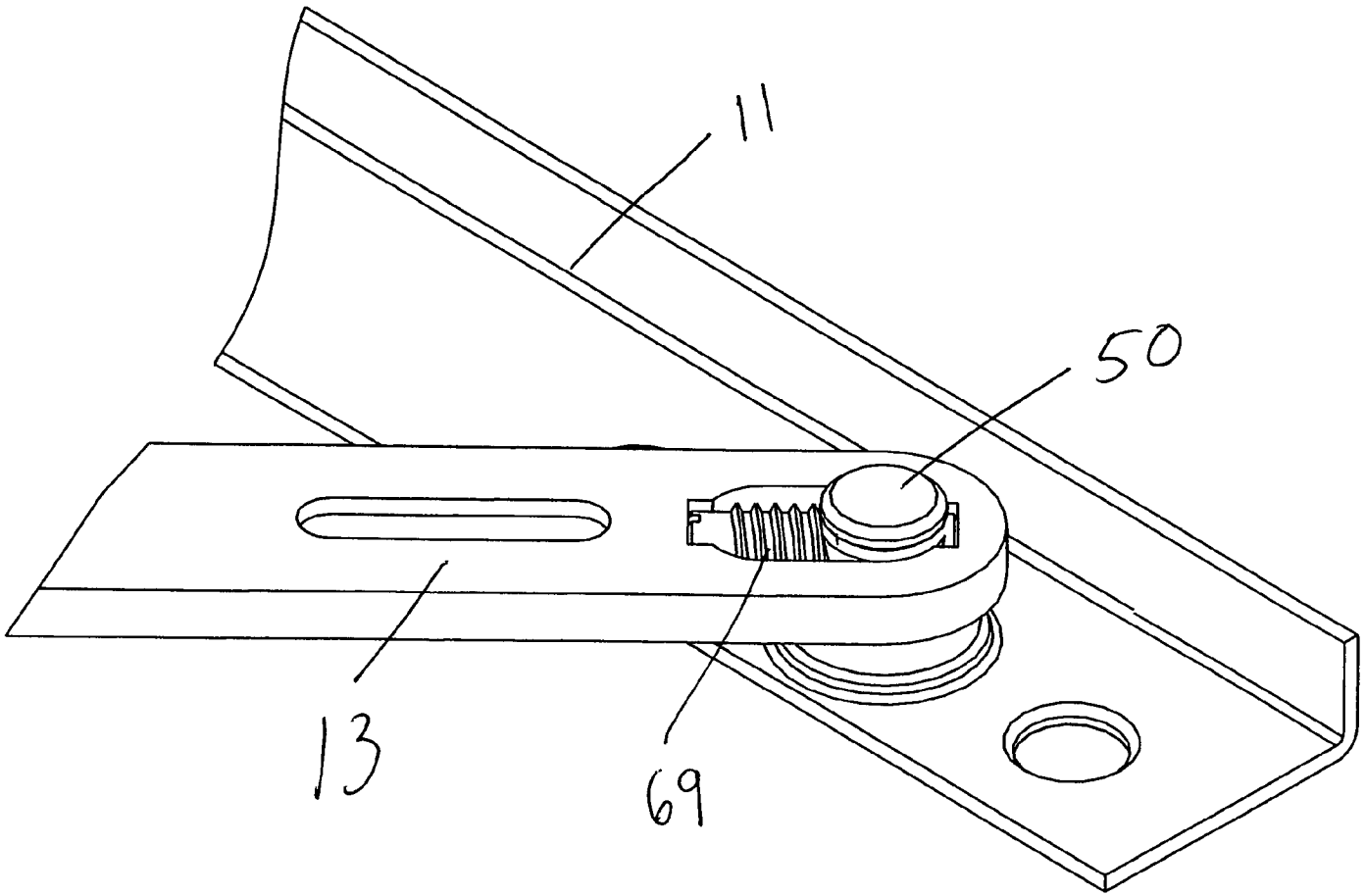
FIG. 36 is a perspective view of the connecting mechanism of FIG. 32 with the support arm attached.
Figure 37:
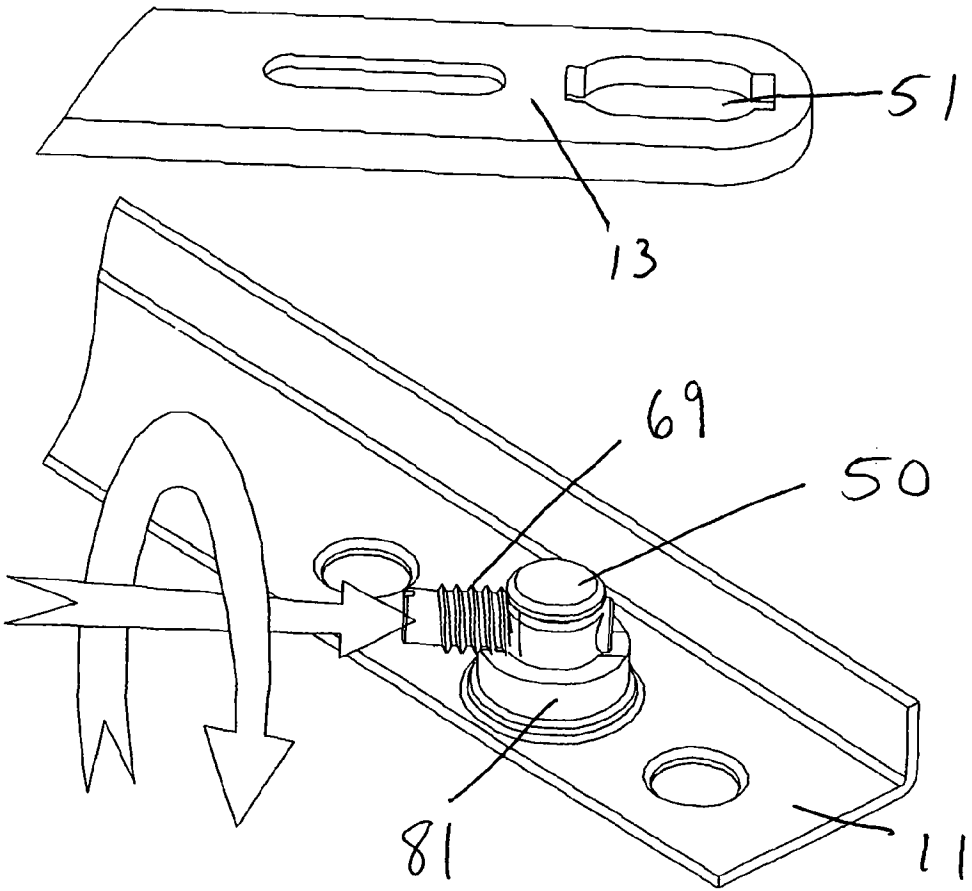
FIG. 37 is a perspective view of the connecting mechanism of FIG. 32 with the support arm detached.
Figure 38:
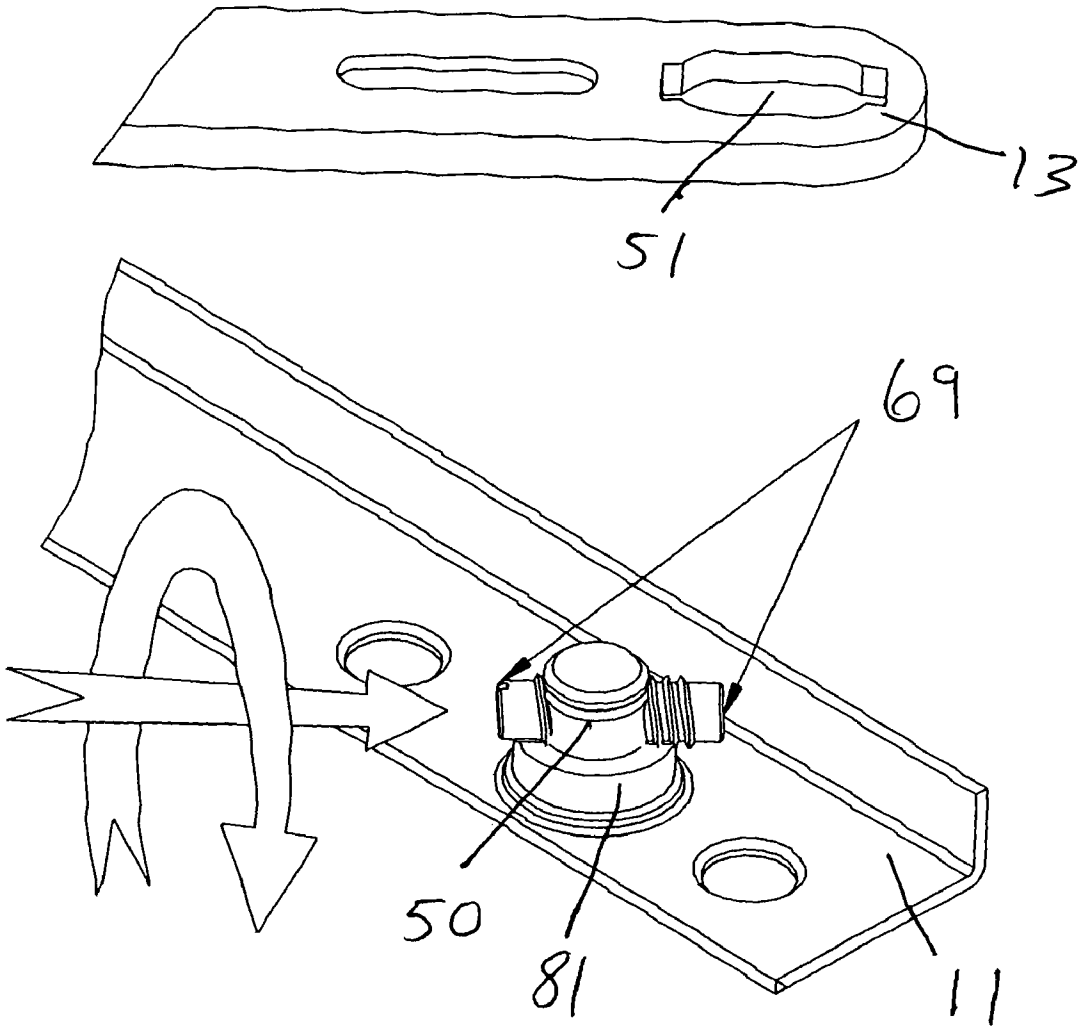
FIG. 38 is a perspective view of the connecting mechanism of FIG. 32 with the support arm detached and the adjustable screw situated in a different position within the orifice of the stud.
Figure 39:
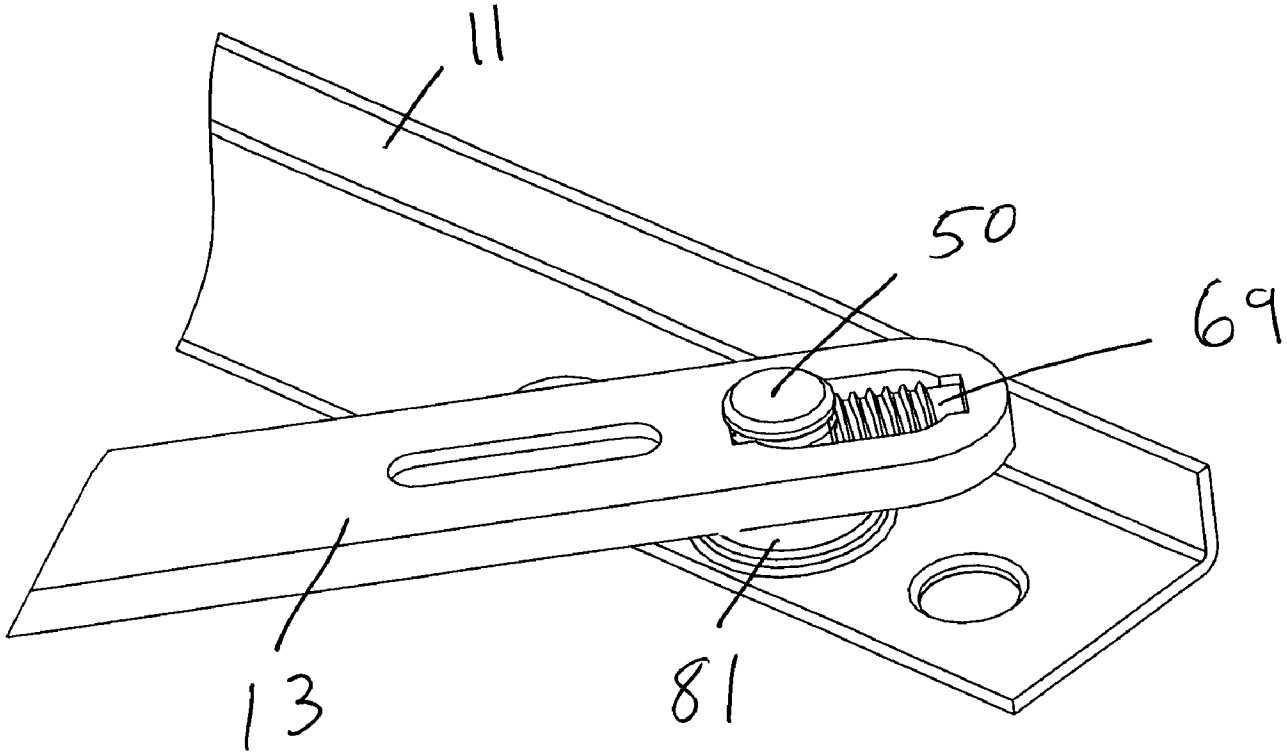
FIG. 39 is a perspective view of the connecting mechanism of FIG. 32 with the support arm attached and the adjustable screw situated in the same position as in FIG. 38.
Figure 40:
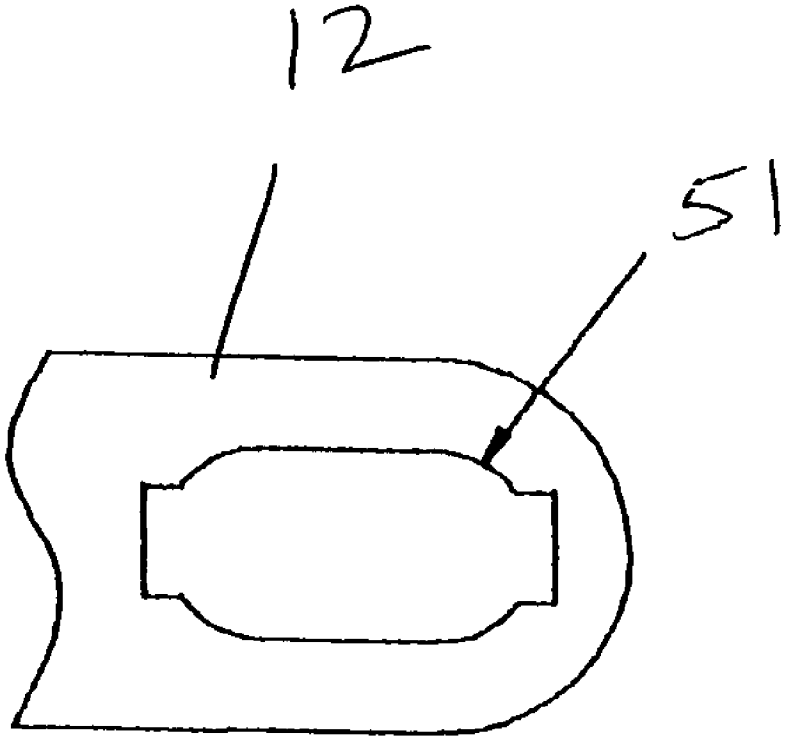
FIG. 40 is a top view of the orifice in the support arm that interacts with the connecting mechanism of FIG. 32.

There are several means for securing the support arm to the track and ensuring proper functioning of the casement window hinge of the present invention. In one embodiment, illustrated in FIGS. 31-40, a stud 50 extends upward from the surface of the first side 17 of the track 11, connected by any means practicable to one knowledgeable in the art. This stud 50 reeves into an orifice in whatever securing means in either the second shoe 44, block 45, or simply, the support arm 13 itself. The stud 50, shown in FIG. 31, is generally cylindrical in shape and, in the preferred embodiment, the stud or pin 50 will generally have a crown 62 and a body 63. The crown 62 is characterized by a flat upper surface 64, a flange 65 extending downward from the upper surface 64, and a recessed track 66 extending inward from the flange 65, in which a connecting mechanism, such as a removable clip, may fit. The body 63 of the stud 50 also has a sidewall 67 which preferably contains an orifice 68 that runs completely through the center of the stud. In one embodiment, this orifice 68 is used to house a screw 69, shown in FIG. 32-34, which is secured within the orifice's confines. This screw 69 is preferably removable and adjustable to permit greater variation in the pivotability of the hinge 10 (see FIGS. 36-39). When the stud 50 is placed through the orifice in the support arm 51, the orifice 51, pictured in FIG. 40, will be shaped to fit both the stud 50 and the screw 69 and, as such, the connection between the support arm 13 and the stud 50 will be more secure and the casement hinge 10 will have greater adjustability. The stud 50 herein disclosed also may be enclosed within a sheath 81 as illustrated in the drawings.

Figure 41:
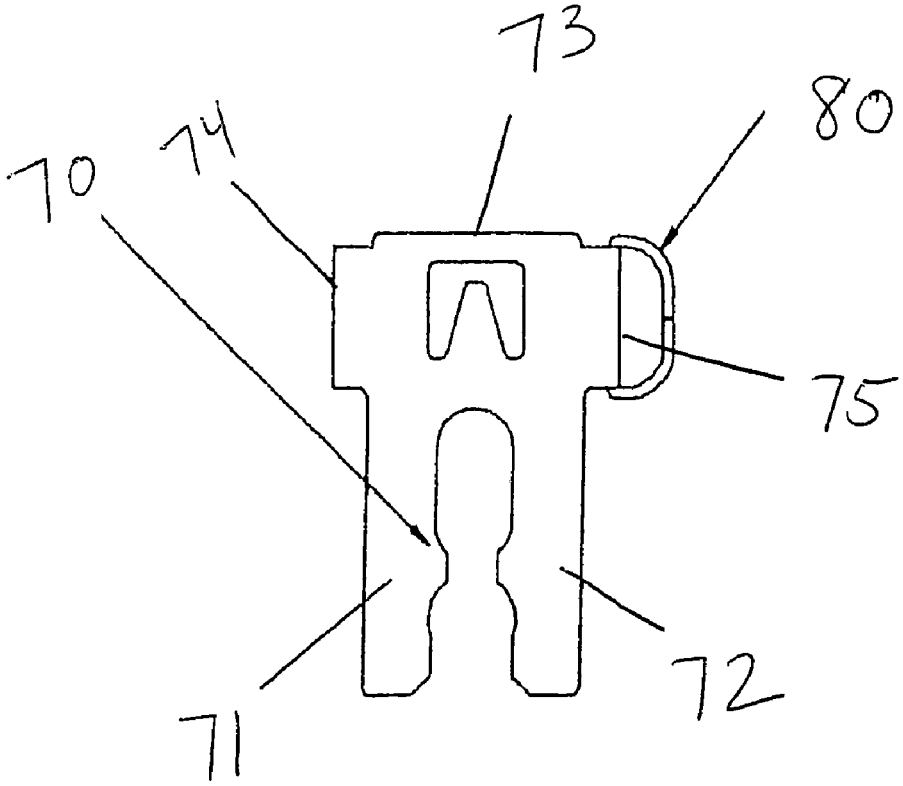
FIG. 41 is a top view of a preferred embodiment of the removable clip of the casement window hinge of the present invention.
Figure 42:
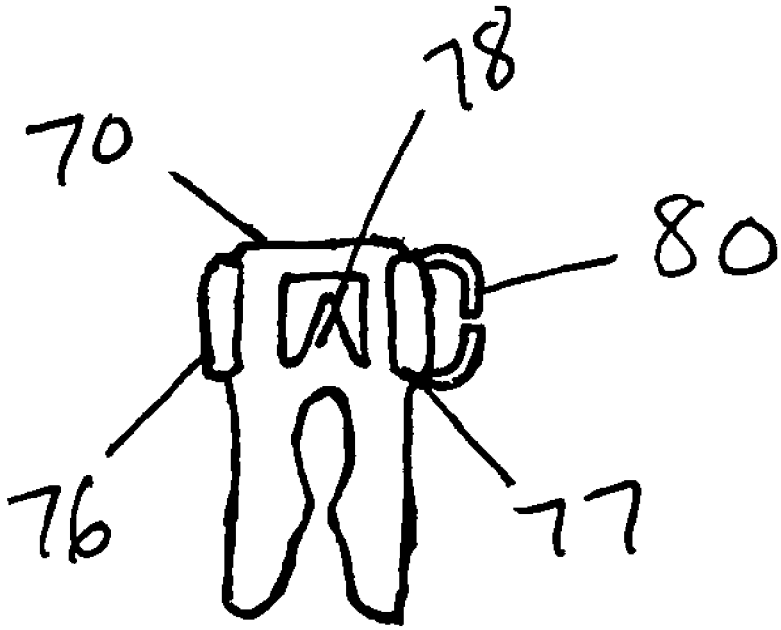
FIG. 42 is a view of the underside of the removable clip of FIG. 41.
Figure 43:
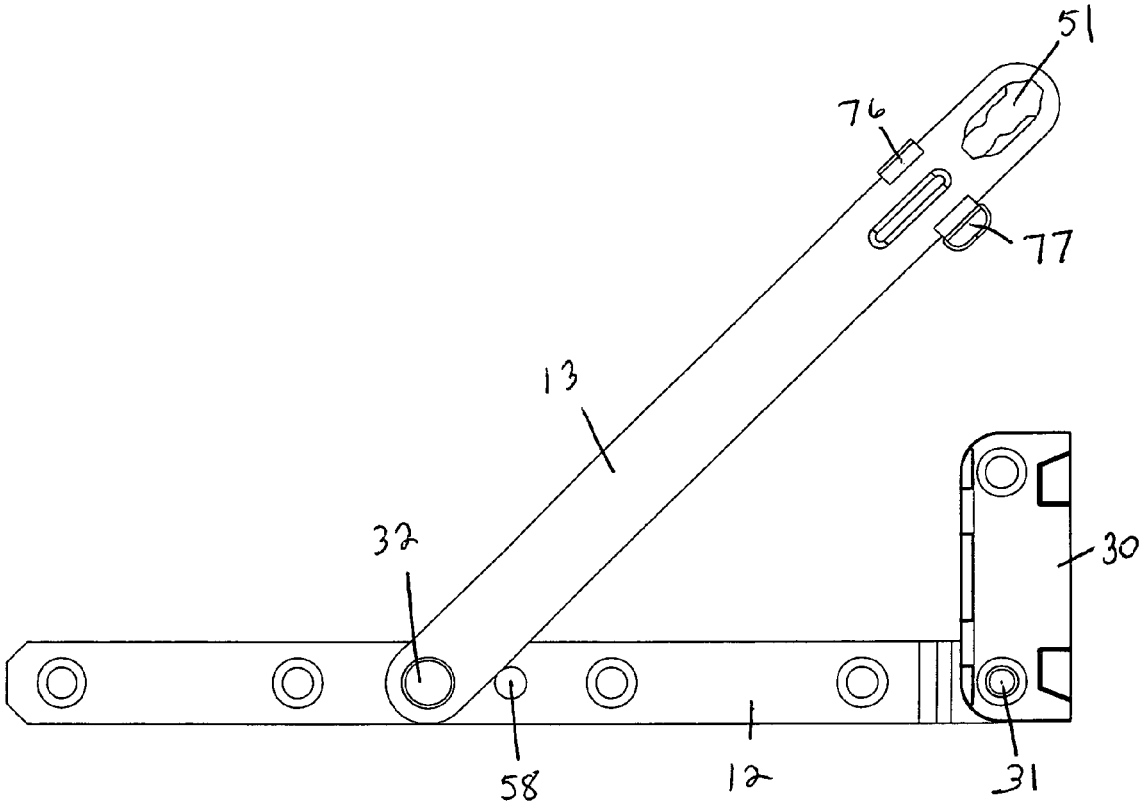
FIG. 43 is a bottom view of the sash arm and support of the casement window hinge of the present invention.

In the preferred embodiment of the present invention, the support arm 13 is retained in the recessed track on the pin or stud 50 in the second shoe, block, or track around which it pivots by a connecting means, preferably a removable clip 70, pictured in FIGS. 41-42. This clip 70 is preferably a sliding clip and rides along the support arm 13 and engages with the pin or stud 50. This preferred clip 70 may be generally of any shape, but it has a first arm 71 and a second arm 72 that are shaped to encircle the pin or stud. The arms 71 and 72 are connected by a flat base portion 73 that extends from the arms. At one side of the base portion 73, there is a first sidewall 74 extending downwardly and a second sidewall 75 extending from the opposite side of the base portion 73. Extending inwardly from each of the flanges 74 and 75 is a retaining means 76 and 77. In operation, the support arm 13 is received by the area formed by the underside of the base portion 78, the flanges 74 and 75, and retaining means 76 and 77 (see FIG. 43). If this embodiment is used, a slot 79 may be cut into the support arm to allow the clip to move between two positions, fixed and unfixed. A flange 91 extending downward from the clip 70 fits into the slot 79 in the support arm 13 rides along it to move the clip between the fixed and unfixed position. This action permits the arm 13 to be released for ease of installation of the window without risking the loss of the clip and to allow a user to open the window wider than permitted by the hinge in a dangerous circumstance.

In the preferred embodiment, in order to enhance the ease with which this clip may be removed, the clip 70 has at least one gripping mechanism, preferably a protrudent ring 80, extending outwardly from one of the flanges 74 and 75 of the base portion 73 of the sliding clip 70. Although the protrudent ring 80 is preferably circular in shape, it may be of any shape useful to one skilled in the art. The protrudent ring's utility is that it may be gripped by a user and used to slide the clip 70 upward along the support arm 13 in order to disengage it from the pin or stud 50 to which it is connected. When the clip 70 is disengaged, the support arm 13 may be disconnected from the track 11 and the window may be opened wider than previously permitted by the hinge 10.

The support arm 13, second shoe 44, and/or block 45 are preferably secured to the track 11 through orifices in the support arm 51, second shoe 82, block 35 and the track 22 that generally line up with each other by a screw or other means 50 that preferably passes through the track orifice and enters the window frame. As illustrated by FIGS. 45-48, the second shoe has a recessed base section 83 that has an orifice 84, separate from the one that connects to the support arm 13, that receives a rivet or pin for pivotally securing the shoe 44 to the track 11. Preferably, the orifice 84 or slot is oblong. The longer the slot, the greater the amount of adjustability that is possible along the track of the hinge. For instance, this shape permits a second shoe to be adjusted longitudinally in the event the casement hinge needs to be adjusted. The connecting mechanism will also provide further anchoring of the hinge to the window frame. Adjacent the recessed base section 83 there is preferably a raised ledge 85 that provides additional strength to the shoe 44. On the side of the ledge 85 that is opposite the recessed base section 83 there is a tongue 86 that is provided with a plurality of teeth 87. Running along the rear of the shoe is a ridge or flange 88 that helps retains the second hinge shoe 44 to the rail 18. Gear wheel 89 may be rotatably secured to the track 11 by a rivet. The gear wheel 89 has a head 90, which is preferably slotted in some manner to permit a screw driver or other type of driver to turn the gear wheel. The teeth on the wheel mesh with the teeth on the tongue 86 and as the gear wheel is turned the tongue is moved in a longitudinal direction within the slot 84. The teeth on the gear wheel and the shoe permit the shoe to be adjusted over a wider range of locations then has heretofore been possible with the prior art hinges.

We claim:

1. An improved hinge for casement windows, said hinge comprising: a track and a shoe that is adapted to travel along said track; and a sash arm being pivotally connected and extending from said shoe; and a support arm, said support arm having a first end and a second end, said first end being pivotally connected to the sash arm and said second end of said support arm being pivotally connected to said track; and wherein said support arm has an orifice for receiving a pin extending from said track, said support arm having a clip for securing said support arm to said track, said clip having at least one grip extending therefrom to assist in moving said clip from a first position to a second position.

2. The improved hinge according to claim 1 wherein when said clip is in said first position, said arm can be removed from proximity with said pin.

3. The improved hinge according to claim 2 wherein said at least one grip comprises at least one grip on a first side of said clip.

4. The improved hinge according to claim 3 wherein said at least one grip further comprises at least one grip on a second side of said clip.

5. The improved hinge according to claim 1 wherein said grip is a ring.

6. The improved hinge according to claim 5 wherein a sidewall of said ring extends from a sidewall of said clip.

7. The improved hinge according to claim 1 wherein said clip has a top surface and a bottom surface and extending from said bottom surface of said clip is a flange that contacts a slot in said support arm.

8. The improved hinge according to claim 1 wherein said pin has an orifice for receiving a screw for adjusting the support arm.

9. The improved hinge according to claim 8 wherein said orifice in said pin is on a side of said pin.

10. The improved hinge of claim 1 wherein said clip comprises a first sidewall extending from a base portion, and a second sidewall extending from said base portion to be opposite said first sidewall.

11. The improved hinge of claim 10 wherein each of said sidewalls has a retaining means extending over the underside of said support arm.

12. An improved hinge for casement windows said hinge comprising: a track and a shoe that is adapted to travel along said track; and a sash arm being pivotally connected and extending from said shoe; and a support arm, said support arm having a first end and a second end, said first end being pivotally connected to the sash arm and said second end of said support arm being pivotally connected to said track; and wherein there is a block between said support arm and said track, said block moving between a first position that permits a window to open a first distance, and a second position that permits said window to open a second distance.

13. The improved hinge according to claim 12 wherein said block moving between said first and second positions is by said block pivoting about a pin that secures said support arm to said track.

14. The improved hinge according to claim 13 wherein said block has a grip to facilitate movement of said block from said first position to said second position.

15. The improved hinge according to claim 14 wherein said grip comprises a groove in a top surface of said block.

16. The improved hinge according to claim 12 wherein said block has a detent when said block moves from said first position to said second position.

17. The improved hinge according to claim 16 wherein said block has a resilient arm forming said detent.

18. The improved hinge according to claim 17 wherein said resilient arm extends from one side of said block.

19. The improved hinge according to claim 12 wherein said block has a lip at one end for receiving a portion of said shoe.

20. An improved hinge for casement windows, said hinge comprising: a track, and a shoe that is adapted to travel along said track; and a sash arm being pivotally connected and extending from said shoe; and a support arm, said support arm having a first end and a second end, said first end being pivotally connected to the sash arm and said second end of said support arm being pivotally connected to said track; and wherein there is a means for stopping said shoe on said track, said stopping means moving between a first position and a second position, and wherein when said stopping means is in said first position said stopping means permits a window to open up to a first distance, and wherein when said stopping means is in said second position, said stopping means permits said window to open up to a second distance.

21. The improved hinge according to claim 20 wherein said means for stopping comprises a detent clip.

22. The improved hinge according to claim 21 wherein said detent clip has a first end and a second end and wherein said first end is secured to said track.

23. The improved hinge according to claim 22 wherein said second end is raised above a surface of said track.

24. The improved hinge according to claim 23 wherein said raised end of said clip prevents said shoe from traveling along said track.

25. The improved hinge according to claim 24 wherein said shoe has a top surface and an underside and said underside has a recess for receiving at least a portion of said clip when said clip contacts said track.

26. An improved casement window hinge comprising:

a track;

a shoe, a portion of said shoe being adapted to engage said track to thereby travel along a portion of said track;

a sash arm, a first end of said sash arm being pivotally connected to said shoe;

a support arm, said support arm having a first end and a second end, said first end being pivotally connected to said sash arm, and said second end of said support arm being pivotally connected to said track; and a block member, said block member being located on said track to be proximate to said pivotal connection of said sash arm with said track, said block member moving thereon between a first position and a second position, said first and second block positions each limiting travel of said shoe to respective first and second travel distances.

27. The improved casement window hinge according to claim 26, wherein said pivotal connection of said support arm to said track comprises an orifice in said support arm receiving a pin extending from said track; and wherein said improved hinge further comprises a clip for securing said support arm to said pin, said clip being slidably disposed upon said support arm.

28. The improved casement window hinge according to claim 27, wherein said slidable clip is moveable between a first position and a second position, said first position being a position where said clip engages said pin to secure said support arm to said pin, and said second position being a position where said clip is disengaged from said pin; and wherein said clip comprises at least one protrusion for use in gripping said clip to provide said sliding clip-to-pin engagement and disengagement.

29. The improved casement window hinge according to claim 28 further comprising an adjustment screw being threadably received transversely in said pin; and wherein said orifice in said sash arm comprises an opening that engages said adjustment screw when said sash arm is pivotally connected to said pin.

30. The improved casement window hinge according to claim 29, wherein adjustment of said hinge comprises: disengaging said clip; removing said support arm; rotating said adjustment screw; repositioning said support arm orifice onto said pin and said adjustment screw; and engaging said clip with said pin.

31. The improved casement window hinge according to claim 30, wherein said block moving between said first and second positions is by said block being pivotally mounted to said pin.

32. The improved casement window hinge according to claim 31, wherein said block being located on said track to be proximate to said pivotal connection of said sash arm with said track comprises said block being pivotally mounted on said pin between said track and said support arm.

33. The improved hinge according to claim 32, wherein said block comprises a groove in a top surface of said block, said groove being graspable to provide said pivoting movement of said block.

34. The improved hinge according to claim 33, wherein said block comprises a resilient arm; and wherein when said block is in said first position, said resilient arm contacts said track to bias said block to remain in said first position.

* * * * *